US009809869B2

(12) United States Patent
Nakagawa et al.

(10) Patent No.: US 9,809,869 B2
(45) Date of Patent: Nov. 7, 2017

(54) THICK-WALLED HIGH-STRENGTH HOT ROLLED STEEL SHEET HAVING EXCELLENT HYDROGEN INDUCED CRACKING RESISTANCE AND MANUFACTURING METHOD THEREOF

(71) Applicant: JFE STEEL CORPORATION, Tokyo (JP)

(72) Inventors: Kinya Nakagawa, Fukuyama (JP); Chikara Kami, Kurashiki (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 15/375,410

(22) Filed: Dec. 12, 2016

(65) Prior Publication Data

US 2017/0088916 A1 Mar. 30, 2017

Related U.S. Application Data

(62) Division of application No. 13/146,751, filed as application No. PCT/JP2010/051647 on Jan. 29, 2010.

(30) Foreign Application Priority Data

Jan. 30, 2009 (JP) ..... 2009-019339
Jan. 30, 2009 (JP) ..... 2009-019342

(51) Int. Cl.

| | |
|---|---|
| ***C21D 8/02*** | (2006.01) |
| ***C21D 9/46*** | (2006.01) |
| ***C22C 38/54*** | (2006.01) |
| ***C22C 38/46*** | (2006.01) |
| ***C22C 38/44*** | (2006.01) |
| ***C22C 38/50*** | (2006.01) |
| ***C22C 38/48*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C22C 38/42*** | (2006.01) |

(52) U.S. Cl.
CPC ..... *C21D 9/46* (2013.01); *C21D 8/0205* (2013.01); *C21D 8/0226* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01)

(58) Field of Classification Search
CPC ..... C21D 8/02; C21D 8/0226; C21D 9/46
USPC ..... 148/506, 602
See application file for complete search history.

(56) References Cited

U.S. PATENT DOCUMENTS

| | | | |
|---|---|---|---|
| 5,853,503 | A | 12/1998 | Seto |
| 5,948,183 | A | 9/1999 | Okada |
| 6,322,642 | B1 | 11/2001 | Bocquet |
| 6,695,932 | B2 | 2/2004 | Kami |
| 6,702,904 | B2 | 3/2004 | Kami |
| 6,899,771 | B2 | 5/2005 | Kami |
| 6,902,632 | B2 | 6/2005 | Kami |
| 7,101,445 | B2 | 9/2006 | Kami |
| 7,501,030 | B2 | 3/2009 | Nakata |
| 7,879,287 | B2 | 2/2011 | Kobayashi |
| 8,920,583 | B2 | 12/2014 | Asahi |
| 2004/0187982 | A1 | 9/2004 | Nakata |
| 2005/0183798 | A1 | 8/2005 | Kobayashi |
| 2009/0065102 | A1 | 3/2009 | Shinohara |
| 2012/0018056 | A1 | 1/2012 | Nakagawa |

FOREIGN PATENT DOCUMENTS

| | | |
|---|---|---|
| CA | 2491307 | 8/2005 |
| CA | 2731908 | 2/2010 |
| CA | 2749409 | 8/2010 |
| CA | 2750291 | 8/2010 |
| CA | 2759256 | 12/2010 |
| CA | 2842897 | 2/2013 |
| CA | 2843588 | 2/2013 |
| EP | 1325967 | 7/2003 |
| EP | 1462535 | 9/2004 |
| EP | 1473376 | 11/2004 |
| EP | 1568792 | 8/2005 |

(Continued)

OTHER PUBLICATIONS

U.S. Notice of Allowance for U.S. Appl. No. 14/169,985, dated Oct. 19, 2016, 12 pages.

(Continued)

*Primary Examiner* — Brian Walck
(74) *Attorney, Agent, or Firm* — RatnerPrestia

(57) ABSTRACT

A thick-walled high-strength hot rolled steel sheet having excellent hydrogen induced cracking resistance which is preferably used as a raw material for a high-strength welded steel pipe of X65 grade or more and a method of manufacturing the thick-walled high-strength hot rolled steel sheet are provided. The composition of the thick-walled high-strength hot rolled steel sheet contains by mass % 0.02 to 0.08% C, 0.50 to 1.85% Mn, 0.02 to 0.10% Nb, 0.001 to 0.05% Ti, 0.0005% or less B in such a manner that (Ti+Nb/2)/C<4 is satisfied or also contains one or two kinds or more of 0.010% or less Ca, 0.02% or less REM, and Fe and unavoidable impurities as a balance. The steel sheet has the structure formed of a bainitic ferrite phase or a bainite phase. Surface layer hardness is 230HV or less in terms of Vickers hardness.

10 Claims, No Drawings

(56) References Cited

FOREIGN PATENT DOCUMENTS

| | | |
|---|---|---|
| EP | 2309014 | 4/2011 |
| JP | 64025916 | 1/1989 |
| JP | 04021719 | 1/1992 |
| JP | 08319538 | 12/1996 |
| JP | 09296216 | 11/1997 |
| JP | 11080833 | 3/1999 |
| JP | 2000160245 | 6/2000 |
| JP | 2001207220 | 7/2001 |
| JP | 2001240936 | 9/2001 |
| JP | 2001286927 | 10/2001 |
| JP | 2002327212 | 11/2002 |
| JP | 2003113440 | 4/2003 |
| JP | 2003231939 | 8/2003 |
| JP | 2004315957 | 11/2004 |
| JP | 2005240051 | 9/2005 |
| JP | 2005281838 | 10/2005 |
| JP | 2006274338 | 10/2006 |
| JP | 2006299415 | 11/2006 |
| JP | 2007138290 | 6/2007 |
| JP | 2007177326 | 7/2007 |
| JP | 2007262467 | 10/2007 |
| JP | 2008056962 | 3/2008 |
| JP | 2008274323 | 11/2008 |
| JP | 2010037567 | 2/2010 |

OTHER PUBLICATIONS

Korean Notice of Allowance for KR 2011-7017827, dated Sep. 13, 2016, 14 pages.

Non-Final Office Action dated May 23, 2016 in U.S. Appl. No. 14/169,985.

Korean Office ACtion dated Feb. 15, 2016 for Korean Application No. 2011-7017827 wtih concise statement of relevance.

Canadian Office Action dated Mar. 17, 2016 for Candian Application No. 2,809,171.

B. Mishra, "Steelmaking Practices and Their Influence on Properties", ASM Handbook, ASM International 2002, pp. 1-9.

Entire patent prosecution history of U.S. Appl. No. 14/169,985, filed Jan. 31, 2014, entitled, "Thick High-Tensile Strength Hot Rolled Steel Sheet Having Excellent Low Temperature Toughness and Manufacturing Method Thereof."

International Preliminary Report on Patentability and Written Opinion dated Mar. 17, 2011, Application No. PCT/JP2009/063981.

International Search Report for PCT/JP2010/051646 dated May 11, 2010.

Kami, Tsutomu et al., Machine-English Translation of Japanese Patent 2005-264217, Sep. 29, 2005.

Office Action dated Apr. 9, 2012 for U.S. Appl. No. 13/056,791, including List of Publications Cited by Applicant and Notice of References Cited.

Office Action dated Mar. 4, 2013 for U.S. Appl. No. 13/056,791, including List of Publications Cited by Applicant.

Supplemental European Search Report dated Jun. 25, 2012, application No. EP 09803078.

Entire patent prosecution history of U.S. Appl. No. 13/056,791, filed Jan. 31, 2011, entitled, "Thick-Walled High-Strength Hot Rolled Steel Sheet With Excellent Low-Temperture Toughness and Method for Producing Same."

Entire patent prosecition history of U.S. Appl. No. 13/146,747, filed Jul. 28, 2011, entitled "Thick High-Tensile Strength Hot-Rolled Steel Sheet Having Excelent Low-Temperature Toughness and Manufacturing Method Thereof," now U.S. Pat. No. 8,784,577, issued Jul. 22, 2014.

Extended European Search Report for European Patent Appklication No. 10735966.3 dated Jan. 27, 2015.

Bainite Committee of Iron & Steel Institute of Japan, "Atlas for Bainitic Microstructures, Continuous-Cooled Zw Microstructures of Low Carbon Steels," vol. 1, Jun. 1992, pp. 1-5.

American Society for Metals, "Metals Handbook, Desk Edition," 1985, pp. 35*16 to 35*23.

Viscorova, Renata, "Untersuchung des Warmeubgergangs bei de Spritzwasserkuhlung unter Berucksichtingung des Einfusses der Verzunderung." Dissertation; genehmigt von der Fakuitat fur Natur- und Materialwissenschaffen der Technischen Universitat Clausthal, Jan. 24, 2007.

Gerdemann et al., "Metallographic Characterization of Baintic Microstructures," International Conference on New Developments in Advanced High-Strength Sheet Steels, 2008, pp. 1-14.

Purcell, Anne, "Mathematical Modeling of Temperature Evolution in the Hot Rolling of Steel," Thesis, Department of Mining and Metallurgical Engineering McGill University.

Kawasaki Steel Technical Report, No. 245, E13, Apr. 1991, pp. 1-14.

Supplementary European Search Report dated Mar. 4, 2014, Application No. EP 10 73 5967.

International Search Report for PCT/JP2010/051647, dated May 11, 2010.

European Office Action for Application No. 10 735 967.1, dated Feb. 15, 2017, 5 pages.

Korean Office Action with partial English language translation for Application No. 10-2016-7011804, dated Feb. 16, 2017, 5 pages.

Final Office Action for U.S. Appl. No. 13/146,751, dated Jan. 13, 2017, 21 pages.

Institut fur Eisenhuttenkunder RWTH Aachem, "Eigenschaften und Anwendungen von Stahien, Band 1, Grundiagen," Aachen: Verlag der Augustinus Buchhandlung, 1003, Ed. 1, Auflage Besonders reveland (Selte/Spalte/Zelie/Fig): Abschnitt 3.3.3.5 Bainit, S. 291, 2. Absatz und Bild 70a-d, pp. 1-28.

Entire patent prosecution history of U.S. Appl. No. 13/146,751, filed Oct. 6, 2011, entitled "Thick-Walled High-Strength Hot Rolled Steel Sheet Having Excellent Hydrogen Induced Cracking Resistance and Manufacturing Method Thereof."

Korean Office Action for Korean Application No. 10-2016-7011804, dated Aug. 11, 2017, including Concise Statement of Relevance of Office Action, 4 pages.

THICK-WALLED HIGH-STRENGTH HOT ROLLED STEEL SHEET HAVING EXCELLENT HYDROGEN INDUCED CRACKING RESISTANCE AND MANUFACTURING METHOD THEREOF

CROSS-REFERENCE TO RELATED APPLICATIONS

This application is a divisional application of U.S. application Ser. No. 13/146,751, filed Oct. 6, 2011 which claims priority to the U.S. National Phase application of PCT International Application No. PCT/JP2010/051647, filed Jan. 29, 2010, and claims priority to Japanese Patent Application No. 2009-019339, filed Jan. 30, 2009, and Japanese Patent Application No. 2009-019342, filed Jan. 30, 2009, the disclosure of which PCT and priority applications are incorporated herein by reference in their entirely for all purposes.

FIELD OF THE INVENTION

The present invention relates to a thick-walled high-strength hot rolled steel sheet which is preferably used as a raw material for manufacturing a high strength welded steel pipe which is required to possess high toughness when used as a line pipe for transporting crude oil, a natural gas or the like and a manufacturing method thereof, and more particularly to the enhancement of low-temperature toughness and hydrogen induced cracking resistance. Here, in this specification, "thick-walled steel sheet" means a steel sheet having a sheet thickness of not less than 8.7 mm and not more than 35.4 mm. Further, "steel sheet" is a concept which includes a steel sheet and a steel strip.

BACKGROUND OF THE INVENTION

Recently, in view of sharp rise of crude oil price since oil crisis, demands for versatility of sources of energy or the like, the drilling for oil and a natural gas and the pipeline construction in a very cold land such as the North Sea, Canada and Alaska have been actively promoted. Further, with respect to a pipeline, there has been observed a trend where a high-pressure operation is performed using a large-diameter pipe to enhance transport efficiency of a natural gas or oil. To withstand a high-pressure operation in a pipeline, it is necessary to forma transport pipe (line pipe) using a thick steel pipe so that a UOE steel pipe which uses a plate as a raw material is used.

Recently, however, along with strong demands for the further reduction of construction cost of a pipeline, demands for the reduction of a material cost of steel pipes are strong. Accordingly, as a transport pipe, in place of a UOE steel pipe which uses a plate as a raw material, a high strength welded steel pipe which is formed using a coil-shaped hot rolled steel sheet (hot rolled steel strip) which possesses high productivity and can be produced at a lower cost as a raw material has been used.

These high strength welded steel pipes are required to possess high strength and, at the same time, excellent low-temperature toughness from a viewpoint of preventing bust-up of a line pipe. To manufacture such a steel pipe which possesses both of high strength and high toughness, attempts have been made to impart higher strength to a steel sheet which is a raw material of a steel pipe by transformation strengthening which makes use of accelerated cooling after hot rolling, precipitation strengthening which makes use of precipitates of alloy elements such as Nb, V, Ti or the like, and attempts have been made to impart higher toughness to the steel sheet through the formation of microstructure by making use of controlled rolling or the like.

Further, a transport pipe (line pipe) which is used for transporting crude oil or a natural gas which contains hydrogen sulfide is required to be excellent in so-called sour gas resistances such as hydrogen introduced cracking resistance (HIC resistance) or stress corrosion cracking resistance in addition to properties such as high strength and high toughness.

To satisfy such a demand, patent document 1, for example, proposes a method of manufacturing a high strength line-pipe-use steel sheet which possesses excellent hydrogen induced cracking resistance. A technique disclosed in patent document 1 is directed to a method of manufacturing a steel sheet for a high-strength electric resistance welded steel pipe of APIX 70 grade or more. That is, patent document 1 describes a method of manufacturing a steel sheet for a high-strength line pipe having excellent hydrogen induced cracking resistance, wherein a slab is heated at a temperature of 1000° C. to 1200° C. and is subjected to hot rolling thus forming a steel sheet, the steel sheet is cooled down such that a surface temperature of the steel sheet becomes a temperature of 500° C. or below by accelerated cooling after hot rolling is finished, the accelerated cooling is stopped once and the steel sheet is reheated such that the surface temperature of the steel sheet becomes a temperature of 500° C. or above and, thereafter, the steel sheet is cooled down to a temperature of 600° C. or below by accelerated cooling at a cooling rate of 3 to 50° C./s. The technique described in patent document 1 adopts intermittent accelerated cooling so that the temperature distribution in the steel sheet becomes uniform in the sheet thickness direction and, at the same time, the hardened structure formed on a surface side is subjected to tempering so that the hydrogen induced cracking resistance of a high strength steel sheet can be enhanced while suppressing the increase of hardness of the steel sheet in the vicinity of a surface of the steel sheet.

Further, patent document 2 proposes a method of manufacturing a high strength steel plate which possesses excellent hydrogen induced cracking resistance. A technique disclosed in patent document 2 is directed to a method of manufacturing a steel sheet for a high-strength steel pipe of APIX 60 grade or more. That is, patent document 2 describes a method of manufacturing a high strength steel plate having excellent hydrogen induced cracking resistance, wherein a slab is heated at a temperature of 1000° C. to 1200° C., the slab is subjected to rolling at a reduction rate of 60% or more in an austenite temperature range of 950° C. or below, a steel plate formed by rolling is cooled from ($Ar_3$-50° C.) or above until a surface temperature of the steel plate becomes 500° C. or below at an average cooling rate of 5 to 20° C./s at a center portion of the steel plate, and the steel plate is cooled to 600° C. or below at an average cooling rate of 5 to 50° C./s at the center portion of the steel plate. The technique described in patent document 2 adopts two-stage cooling which changes a cooling rate in the midst of cooling so that the steel plate can secure desired strength while suppressing hardness of the steel plate in the vicinity of a surface of the steel plate.

PATENT DOCUMENT

[Patent document 1] JP-A-11-80833
[Patent document 2] JP-A-2000-160245

SUMMARY OF THE INVENTION

However, recently, demands for a transport pipe (line pipe) are becoming stricter so that the further improvement of sour resistance of the transport pipe is requested, and the further lowering of surface hardness is requested. The techniques described in patent documents 1 and 2 cannot lower the hardness of a surface layer of the steel sheet to an extent that the recent strict demand for hydrogen induced cracking resistance is satisfied thus giving rise to a drawback that a steel sheet for a high strength welded steel pipe of X65 grades or more which possesses the excellent hydrogen induced cracking resistance cannot be manufactured in a stable manner.

The present invention has been made to overcome the above-mentioned drawbacks, and it aims to provide a thick-walled high-strength hot rolled steel sheet with which a high-strength welded steel pipe of X65 grade or more can be manufactured and possesses excellent hydrogen induced cracking resistance, and a method of manufacturing the thick-walled high-strength hot rolled steel sheet.

Inventors of the present invention have made studies extensively on various factors which influence surface layer hardness. As a result, the inventors have found that it is possible to stably manufacture a thick-walled high-strength hot rolled steel sheet having tensile strength of 520 MPa or more by which a high strength welded steel pipe of X65 grade or more having low surface layer hardness of 230HV or less can be manufactured in the following manner. That is, in manufacturing the hot rolled steel sheet by applying hot rolling consisting of rough rolling and finish rolling to a raw steel material having composition which contains C, Nb, Ti such that C, Nb, Ti satisfy a specific relational formula or in which alloy element quantities are adjusted such that at least one of a carbon equivalent Ceq or Pcm takes a predetermined value or less, the steel sheet is cooled by applying intermittent cooling to the steel sheet after the finish rolling is finished.

The inventors of the present invention have made further studies based on the above-mentioned finding and have made the present invention.

Embodiments of the present invention are described as follows.

A thick-walled high-strength hot rolled steel sheet is provided having a composition which contains by mass % 0.02 to 0.08% C, 1.0% or less Si, 0.50 to 1.85% Mn, 0.03% or less P, 0.005% or less S, 0.1% or less Al, 0.02 to 0.10% Nb, 0.001 to 0.05% Ti, 0.0005% or less B, and Fe and unavoidable impurities as a balance, wherein the steel sheet contains Nb, Ti and C in such a manner that a following formula (1) is satisfied, the steel sheet has the structure formed of a bainitic ferrite phase or a bainite phase, and surface layer hardness is 230HV or less in terms of Vickers hardness.

$$(Ti+Nb/2)/C<4 \quad (1)$$

Here, Ti, Nb, C: contents of respective elements (mass %)

In the thick-walled high-strength hot rolled steel sheet, the composition optionally further contains by mass % one or two kinds or more selected from a group consisting of 0.5% or less V, 1.0% or less Mo, 1.0% or less Cr, 4.0% or less Ni, and 2.0% or less Cu in addition to the above-mentioned composition.

The composition optionally further contains by mass % one or two kinds or more selected from a group consisting of 0.010% or less Ca, 0.02% or less REM, and 0.003% or less Mg in addition to the above-mentioned composition.

The composition optionally further satisfies at least one of a condition that Ceq defined by a following formula (2) is 0.32% or less and a condition that Pcm defined by a following formula (3) is 0.130% or less.

$$Ceq=C+Mn/6+(Cr+Mo+V)/5+(Cu+Ni)/15 \quad (2)$$

$$Pcm=C+Si/30+(Mn+Cu+Cr)/20+Ni/60+Mo/15+V/10+5B \quad (3)$$

Here, C, Si, Mn, Cr, Mo, V, Cu, Ni, B: contents of respective elements (mass %)

A method of manufacturing a thick-walled high-strength hot rolled steel sheet having surface layer hardness of 230HV or less in terms of Vickers hardness and having excellent hydrogen induced cracking resistance is also provided, wherein in manufacturing a hot rolled steel sheet by applying hot rolling consisting of rough rolling and finish rolling to a raw steel material having the composition according to the above-mentioned steel sheet, after the finish rolling is finished, a first cooling step in which the hot rolled steel sheet is cooled by accelerated cooling at an average surface cooling rate of 30° C./s or more until a surface temperature becomes 500° C. or below, a second cooling step in which the hot rolled steel sheet is cooled by air cooling for 10 s or less after the first cooling step is finished, and a third cooling step in which the hot rolled steel sheet is cooled by accelerated cooling to a temperature which falls within a temperature range from 350° C. or above to a temperature below 600° C. at the center of a sheet-thickness at an average cooling rate of 10° C./s or more at the center of the sheet-thickness are applied to the hot rolled steel sheet, and the hot rolled steel sheet is coiled in a coil shape after the third cooling step is finished.

The accelerated cooling in the third cooling step is optionally cooling performed at a heat flow rate of 1.5 Gcal/$m^2$ hr or more in entire surface nuclear boiling.

In the method of manufacturing a thick-walled high-strength hot rolled steel sheet, the composition optionally further contains by mass % one or two kinds or more selected from a group consisting of 0.5% or less V, 1.0% or less Mo, 1.0% or less Cr, 4.0% or less Ni, and 2.0% or less Cu in addition to the above-mentioned composition.

The composition optionally further contains by mass % one or two kinds or more selected from a group consisting of 0.010% or less Ca, 0.02% or less REM, and 0.003% or less Mg in addition to the above-mentioned composition.

In the method of manufacturing a thick-walled high-strength hot rolled steel sheet, the composition optionally further satisfies at least one of a condition that Ceq defined by a following formula (2) is 0.32% or less and a condition that Pcm defined by a following formula (3) is 0.13% or less.

$$Ceq=C+Mn/6+(Cr+Mo+V)/5+(Cu+Ni)/15 \quad (2)$$

$$Pcm=C+Si/30+(Mn+Cu+Cr)/20+Ni/60+Mo/15+V/10+5B \quad (3)$$

Here, C, Si, Mn, Cr, Mo, V, Cu, Ni, B: contents of respective elements (mass %)

A method of manufacturing a thick-walled high-strength hot rolled steel sheet having tensile strength of 520 MPa or more and a surface layer hardness of 230HV or less in terms of Vickers hardness and having excellent hydrogen induced cracking resistance is provided, wherein in manufacturing a hot rolled steel sheet by applying hot rolling consisting of rough rolling and finish rolling to a raw steel material having the composition according to the above-mentioned steel sheet, after the finish rolling is finished, a first cooling step in which the hot rolled steel sheet is cooled by accelerated cooling at an average cooling rate of 20° C./s or more and less than a martensite formation critical cooling rate on a surface of the hot rolled steel sheet until a surface temperature becomes a temperature not more than an $A_{r3}$ transformation temperature and not less than an Ms temperature, a second cooling step in which the hot rolled steel sheet is rapidly cooled to a temperature within a temperature range from 350° C. or above to a temperature below 600° C. at the center of a sheet-thickness after the first cooling step is finished, and a third cooling step in which, after the second cooling step is finished, the hot rolled steel sheet is coiled in a coil shape at a coiling temperature falling within a temperature range from 350° C. or above to a temperature below 600° C. in terms of a temperature at the center of sheet-thickness and, thereafter, a temperature of the hot rolled steel sheet at least at a position of ¼ sheet-thickness to ¾ sheet-thickness in a coil thickness direction is held or kept within a temperature range from 350° C. or above to a temperature below 600° C. for 30 min or more are sequentially applied to the hot rolled steel sheet.

The rapid cooling in the second cooling step is optionally cooling at a heat flow rate of 1.0 Gcal/$m^2$ hr or more in entire surface nuclear boiling.

The composition optionally further contains by mass % one or two kinds or more selected from a group consisting of 0.5% or less V, 1.0% or less Mo, 1.0% or less Cr, 4.0% or less Ni, and 2.0% or less Cu in addition to the above-mentioned composition.

The composition optionally further contains by mass % one or two kinds selected from a group consisting of 0.010% or less Ca, 0.02% or less REM, 0.003% or less Mg in addition to the above-mentioned composition.

The composition optionally further satisfies at least one of a condition that Ceq defined by a following formula (2) is 0.32% or less and a condition that Pcm defined by a following formula (3) is 0.13% or less.

$$Ceq=C+Mn/6+(Cr+Mo+V)/5+(Cu+Ni)/15 \quad (2)$$

$$Pcm=C+Si/30+(Mn+Cu+Cr)/20+Ni/60+Mo/15+V/10+5B \quad (3)$$

Here, C, Si, Mn, Cr, Mo, V, Cu, Ni, B: contents of respective elements (mass %)

According to an embodiment of the present invention, the high-strength hot rolled steel sheet which possesses high strength of tensile strength: 520 MPa or more and low surface hardness of 230HV or less, has a large sheet thickness of 8.7 mm or more, possesses excellent hydrogen induced cracking resistance, and can be preferably used as a raw material for a high strength welded steel pipe can be manufactured in a stable manner whereby the present invention can acquire an outstanding industrial advantageous effect. Further, by using the hot rolled steel sheet manufactured by the present invention as a raw material, the present invention can also acquire an advantageous effect that the high strength welded steel pipe possessing excellent hydrogen induced cracking resistance of X65 grade or more can be manufactured at a low cost and also in a stable manner.

DETAILED DESCRIPTION OF THE INVENTION

Firstly, the reason that the composition of the raw steel materials used in embodiments of the present invention may be limited is explained. Unless otherwise specified, mass % is simply described as %.

C: 0.02 to 0.08%

C is an element which performs the action of increasing strength of steel. The hot rolled steel sheet preferably contains 0.02% or more of C for securing desired high strength. On the other hand, when the content of C exceeds 0.08%, a structural fraction of a secondary phase such as pearlite is increased so that base material toughness and toughness of a welded heat affected zone are deteriorated. Accordingly, the content of C is limited to a value which falls within a range from 0.02 to 0.08%. The content of C is preferably limited to a value which falls within a range from 0.03 to 0.05%.

Si: 1.0% or Less

Si is a deoxidizer and also performs the action of increasing strength of steel through solution strengthening and the enhancement of hardenability. Such an advantageous effect can be acquired when the content of Si is 0.01% or more. On the other hand, when the content of Si exceeds 1.0%, oxide which contains Si is formed at the time of electric resistance welding so that quality of a welded portion is deteriorated and, at the same time, toughness of a welded heat affected zone is deteriorated. Accordingly, the content of Si is limited to 1.0% or less. The content of Si is preferably limited to 0.1 to 0.4%.

Mn: 0.50 to 1.85%

Mn performs the action of enhancing hardenability so that Mn increases strength of the steel sheet through the enhancement of hardenability. Further, Mn forms MnS thus fixing S and hence, the grain boundary segregation of S is prevented whereby cracking of slab (raw steel material) can be suppressed. To acquire such an advantageous effect, it is advantageous to set the content of Mn to 0.50% or more. On the other hand, when the content of Mn exceeds 1.85%, weldability, and hydrogen induced cracking resistance are deteriorated. Further, when the content of Mn is large, solidification segregation at the time of casting slab is promoted so that Mn concentrated parts remain in a steel sheet so that the occurrence of separation is increased. To dissipate the Mn concentrated parts, it is advantageous to heat the hot rolled steel sheet at a temperature exceeding 1300° C. and it is unrealistic to carry out such heat treatment in an industrial scale. Accordingly, the content of Mn is limited to a value which falls within a range from 0.50 to 1.85%. The content of Mn is preferably limited to a value which falls within a range from 0.8 to 1.2%.

P: 0.03% or Less

Although P is contained in steel as an unavoidable impurity, P performs the action of increasing strength of steel. However, when P is contained excessively exceeding 0.03%, weldability is deteriorated. Accordingly, the content of P is limited to 0.03% or less. The content of P is preferably limited to 0.01% or less.

S: 0.005% or Less

S is also contained in steel as an unavoidable impurity in the same manner as P. However, when S is contained exceeding 0.005%, cracks occur in slab, and coarse MnS is formed in a hot rolled steel sheet thus deteriorating ductility. Accordingly, the content of S is limited to 0.005% or less. The content of S is preferably limited to 0.001% or less.

Al: 0.1% or Less

Al is an element which acts as a deoxidizer and, to acquire such an advantageous effect, it is desirable to set the content of Al to 0.005% or more, and it is more desirable to set the content of Al to 0.01% or more. On the other hand, when the content of Al exceeds 0.1%, cleanability of a welded part at the time of electric resistance welding is remarkably deteriorated. Accordingly, the content of Al is limited to 0.1% or less. The content of Al is preferably limited to a value which falls within a range from 0.005 to 0.05%.

Nb: 0.02 to 0.10%

Nb is an element which performs the action of suppressing the coarsening and the recrystallization of austenite. Nb enables rolling in an austenite un-recrystallization temperature range in hot finish rolling and is finely precipitated as carbonitride so that Nb performs the action of increasing strength of hot rolled steel sheet with the small content without deteriorating weldability. To acquire such advantageous effects, it is advantageous to set the content of Nb to 0.03% or more. On the other hand, when the content of Nb exceeds 0.10%, a rolling load during hot finish rolling is increased and hence, there may be a case where hot rolling becomes difficult. Accordingly, the content of Nb is limited to a value which falls within a range from 0.02 to 0.10%. The content of Nb is preferably limited to a value which falls within a range from 0.03% to 0.07%. The content of Nb is more preferably limited to a value which falls within a range from 0.04% to 0.06%.

Ti: 0.001 to 0.05%

Ti performs the action of preventing cracks in slab (raw steel material) by forming nitride thus fixing N, and is also finely precipitated as carbide so that strength of a steel sheet is increased. Although such an advantageous effect becomes outstanding when the content of Ti is 0.001% or more, when the content of Ti exceeds 0.05%, a yield point is remarkably elevated due to precipitation strengthening. Accordingly, the content of Ti is limited to a value which falls within a range from 0.001 to 0.05%. The content of Ti is preferably limited to a value which falls within a range from 0.005% to 0.03%.

In the present invention, the hot rolled steel sheet preferably contains Nb, Ti, C which fall within the above-mentioned ranges, and the contents of Nb, Ti, C are adjusted such that the following formula (1) is satisfied.

$$(Ti+Nb/2)/C<4 \quad (1)$$

Nb, Ti are elements which have strong carbide forming tendency, wherein most of C is turned into carbide when the content of C is low, and the drastic decrease of solid-solution C content in ferrite grains is considered. The drastic decrease of solid-solution C content in ferrite grains adversely influences circumferential weldability (girth welding property) of a steel pipe at the time of constructing pipelines. When girth welding is applied to a steel pipe which is manufactured using a steel sheet in which the solid-solution C content in ferrite grains is extremely lowered as a line pipe, the grain growth in a heat affected zone (HAZ) of a girth welded part becomes conspicuous thus giving rise to a possibility that toughness of the heat affected zone of the girth welded part is deteriorated. Accordingly, the contents of Nb, Ti, C are preferably adjusted so as to satisfy the formula (1). Due to such adjustment, the solid-solution C content in ferrite grains can be set to 10 ppm or more and hence, the deteriorating of toughness of the heat affected zone of the girth weld portion can be prevented.

B: 0.0005% or Less

B is an element which has a strong tendency of generating segregation in a grain boundary and contributes to the increase of strength of steel through the enhancement of hardenability. This advantageous effect can be acquired when the content of B is 0.0001% or more. However, toughness of steel is deteriorated when the content of B exceeds 0.0005%. Accordingly, the content of B is limited to 0.0005% or less.

Although the above-mentioned contents are basic contents of the hot rolled steel sheet, in addition to the basic composition, the hot rolled steel sheet may selectively contain one or two kinds or more selected from a group consisting of 0.5% or less V, 1.0% or less Mo, 1.0% or less Cr, 4.0% or less Ni and 2.0% or less Cu and/or one or two kinds selected from a group consisting of 0.010% or less Ca, 0.02% or less REM and 0.003% or less Mg if necessary.

One or two kinds or more selected from a group consisting of 0.5% or less V, 1.0% or less Mo, 1.0% or less Cr, 4.0% or less Ni and 2.0% or less Cu All of V, Mo, Cr, Ni and Cu are elements which enhance hardenability and increase strength of the steel sheet, and the hot rolled steel sheet may contain one or two kinds or more selected from these elements when necessary.

V is an element which performs the action of increasing strength of a steel sheet through the enhancement of hardenability and the formation of carbonitride. Such an advantageous effect becomes outstanding when the content of V is 0.01% or more. On the other hand, when the content of V exceeds 0.5%, the weldability is deteriorated. Accordingly, the content of V is preferably limited to 0.5% or less. The content of V is more preferably limited to 0.08% or less.

Mo is an element which performs the action of increasing strength of a steel sheet through the enhancement of hardenability and the formation of carbonitride. Such an advantageous effect becomes outstanding when the content of Mo is 0.01% or more. On the other hand, when the content of Mo exceeds 1.0%, the weldability is deteriorated. Accordingly, the content of Mo is preferably limited to 1.0% or less. The content of Mo is more preferably limited to a value which falls within a range from 0.05 to 0.35%.

Cr is an element which performs the action of increasing strength of a steel sheet through the enhancement of hardenability. Such an advantageous effect becomes outstanding when the content of Cr is 0.01% or more. On the other hand, when the content of Cr exceeds 1.0%, there arises a tendency that a welding defect frequently occurs at the time of electric resistance welding. Accordingly, the content of Cr is preferably limited to 1.0% or less. The content of Cr is more preferably limited to less than 0.30%.

Ni is an element which performs the action of increasing strength of steel through the enhancement of hardenability and also performs the action of enhancing toughness of a steel sheet. To acquire such an advantageous effect, the content of Ni is preferably set to 0.01% or more. However, even when the content of Ni exceeds 4.0%, the advantageous effect is saturated so that an advantageous effect corresponding to the content is not expected whereby the content of Ni exceeding 4.0% is economically disadvantageous. Accordingly, the content of Ni is preferably limited to 4.0% or less. The content of Ni is more preferably limited to a value which falls within a range from 0.10 to 1.0%.

Cu is an element which performs the action of increasing strength of a steel sheet through the enhancement of hardenability and solution strengthening or precipitation strengthening. To acquire such an advantageous effect, the content of Cu is desirably set to 0.01% or more. However, when the content of Cu exceeds 2.0%, hot-rolling workability is deteriorated. Accordingly, the content of Cu is preferably limited to 2.0% or less. The content of Cu is more preferably limited to a value which falls within a range from 0.10 to 1.0%.

One or two kinds selected from a group consisting of 0.010% or less Ca, 0.02% or less REM, 0.003% or less Mg All of Ca, REM and Mg are elements which contribute to a shape control of sulfide for forming spread coarse sulfide into spherical sulfide, and the composition can selectively contain these elements when necessary. To acquire such an advantageous effect, it is desirable that the composition contains 0.001% or more of Ca, 0.001% or more of REM. However, when the content of Ca exceeds 0.010% or the content of REM exceeds 0.02%, cleanliness of the steel sheet is deteriorated. Accordingly, it is desirable to limit the content of Ca to 0.010% or less and the content of REM to 0.02% or less.

It is preferable that the composition contains Ca within the above-mentioned range, and the content of Ca is adjusted such that ACR which is defined by the following formula satisfies 1.0 to 4.0 in terms of contents of O and S.

$$ACR=\{Ca—O\times(0.18+130Ca)\}/1.25S$$

(here, Ca, O, S: contents of respective elements (mass %))

Accordingly, deteriorating of corrosion resistance and corrosion cracking resistance is prevented even under a sour environment.

Mg is, in the same manner as Ca or the like, an element which forms sulfide or oxide, suppresses the formation of coarse sulfide MnS, and contributes to a shape control of sulfide. The composition may contain Mg when necessary. Such advantageous effects can be acquired when the content of Mg is 0.0005% or more. However, when the content of Mg exceeds 0.003%, clusters of Mg oxide or Mg sulfide are formed thus deteriorating toughness of the steel sheet. Accordingly, when the composition contains Mg, it is preferable to limit the content of Mg to 0.003% or less.

It is preferable that the composition of the hot rolled steel sheet contains the above-mentioned components within the above-mentioned ranges respectively, and the composition is adjusted such that Ceq defined by a following formula (2) satisfies 0.32% or less, or Pcm defined by a following formula (3) satisfies 0.13% or less.

$$Ceq=C+Mn/6+(Cr+Mo+V)/5+(Cu+Ni)/15 \quad (2)$$

(here, C, Si, Mn, Cr, Mo, V, Cu, Ni: contents of respective elements (mass %))

$$Pcm=C+Si/30+(Mn+Cu+Cr)/20+Ni/60+Mo/15+V/10+5B \quad (3)$$

(here, C, Si, Mn, Cr, Mo, V, Cu, Ni, B: contents of respective elements (mass %))

When Ceq exceeds 0.32% or Pcm exceeds 0.13%, it becomes difficult to adjust the composition such that hardness of a surface layer becomes 230HV or less, and also hardenability becomes high so that circumferential welded part toughness is deteriorated.

The balance other than the above-mentioned components is constituted of Fe and unavoidable impurities.

As unavoidable impurities, the steel sheet is allowed to contain 0.005% or less 0, 0.008% or less N, and 0.005% or less Sn.

O: 0.005% or Less

O forms various oxides in steel and deteriorates hot-rolling workability, corrosion resistance, toughness and the like. Accordingly, it is desirable to reduce the content of O as much as possible. However, since the extreme reduction of O brings about the sharp rise of a refining cost, the steel sheet is allowed to contain up to 0.005% O.

N: 0.008% or Less

Although N is an element which is unavoidably contained in steel, the excessive content of N frequently causes cracks at the time of casting a slab. Accordingly, it is desirable to reduce the content of N as much as possible. However, the steel sheet is allowed to contain up to 0.008% N.

Sn: 0.005% or Less

Sn is an element which is mixed into the steel sheet from the scrap used as a steel-making raw material and is unavoidably contained in steel. Sn is an element which is liable to be segregated in a grain boundary or the like and hence, when the content of Sn becomes large, grain boundary strength is deteriorated thus deteriorating toughness. However, the steel sheet is allowed to contain up to 0.005% Sn.

Here, as a method of manufacturing a raw steel material, it is preferable to manufacture the raw steel material in such a manner that molten steel having the above-mentioned composition is produced by a usual melting method such as a converter, and molten metal is cast into the raw steel material such as slab by a usual casting method such as a continuous casting method. However, the present invention is not limited to such a method.

The raw steel material having the above-mentioned composition is heated and is subjected to hot rolling thus forming a hot rolled steel sheet (steel strip).

As a method of manufacturing a raw steel material, it is preferable to manufacture the raw steel material in such a manner that molten steel having the above-mentioned composition is produced by a usual melting method such as a converter, and molten metal is cast into the raw steel material such as slab by a usual casting method such as a continuous casting method. However, the present invention is not limited to such a method.

The hot rolling is constituted of rough rolling which turns the raw steel material (slab) into a sheet bar by heating, and finish rolling which turns the sheet bar into a hot rolled steel sheet.

Although heating temperature of a raw steel material (slab) is not necessarily limited provided that the raw steel material (slab) can be rolled into a hot rolled steel sheet, the heating temperature is preferably set to a temperature which falls within a range from 1000 to 1300° C. When the heating temperature is below 1000° C., the deformation resistance is high so that a rolling load is increased whereby a load applied to a rolling mill becomes excessively large. On the other hand, when the heating temperature becomes high exceeding 1300° C., crystal grains become coarse so that low-temperature toughness is deteriorated, and a scale generation amount is increased so that a yield is lowered. Accordingly, the heating temperature in hot rolling is preferably set to a temperature which falls within a range from 1000 to 1300° C. The heating temperature is more preferably set to a temperature which falls within a range from 1050 to 1250° C.

A sheet bar is formed by applying rough rolling to the heated raw steel material (slab). Conditions for rough rolling are not necessarily limited provided that the sheet bar of desired size and shape can be obtained.

Finish rolling is further applied to the obtained sheet bar thus forming a hot rolled steel sheet.

In finish rolling, from a viewpoint of enhancing toughness, finish rolling completion temperature is preferably set to ($A_{C3}$−50° C.) or less and 800° C. or less, and a total rolling reduction rate (%) in a temperature range of 1000° C. or below is preferably set to 60% or more. This is because when the finish rolling completion temperature falls outside the above-mentioned finish rolling completion temperature range or when the total rolling reduction rate in the temperature range of 1000° C. or below is less than 60%, fine structure cannot be obtained and hence, toughness is deteriorated.

The hot rolled steel sheet has the structure formed of a bainitic ferrite phase or bainite phase, and surface layer hardness of the steel sheet is 230HV or less in terms of Vickers hardness. To acquire such a steel sheet, the present invention provides, as a basic step, the method of manufacturing a thick-walled high-strength hot rolled steel sheet having a surface layer hardness of 230HV or less in Vickers hardness, wherein the cooling step which is performed after the finish rolling is constituted of the first cooling step in which the steel sheet is cooled by accelerated cooling immediately after completion of the finish rolling at the average surface cooling rate equal to or more than predetermined cooling rate such that the precipitation of polygonal ferrite on the surface of the steel sheet is prevented until the surface temperature becomes a temperature equal to or below the $A_{r3}$ transformation temperature, and the second cooling step in which, after the first cooling step is finished, the steel sheet is cooled by accelerated cooling at the average cooling rate at the center of the sheet thickness to the temperature within the temperature range from 350° C. or above to a temperature below 600° C. at the center of the sheet thickness such that the precipitation of polygonal ferrite or pearlite at a sheet-thickness center portion is prevented, and the hot rolled steel sheet is coiled in a coil shape after the second cooling step is finished. Further, to further lower hardness of the surface of the steel sheet, a step of air cooling is performed between the first cooling step and the second cooling step or a step of holding or keeping the steel strip within a temperature range from 350° C. or above to a temperature below 600° C. for 30 minutes or more is performed after coiling.

As specific examples of a manufacturing method provided by the present invention, a first embodiment and a second embodiment are described hereinafter. The respective embodiments are explained in detail hereinafter.

First Embodiment

In the first embodiment, after being subjected to finish rolling, the hot rolled steel sheet is subjected to the first cooling step and the second cooling step subsequently, is subjected to the third cooling step thereafter, and is coiled in a coil shape after completion of the third cooling step.

In the first cooling step, immediately after the completion of the finish rolling, the hot rolled steel sheet is subjected to accelerated cooling at an average surface cooling rate of 30° C./s or more until the surface temperature becomes 500° C. or below. Here, "immediately after the finish rolling" means that cooling is started within 10 s after the completion of the finish rolling.

A surface temperature control is performed in the accelerated cooling in the first cooling step. When the average surface cooling rate is less than 30° C./s, polygonal ferrite precipitates so that the hot rolled steel sheet cannot achieve the desired enhancement of strength and the desired enhancement of toughness. The preferred average surface cooling rate is 100 to 300° C./s. Also in the first cooling step, a cooling stop temperature in the acceleration cooing is set to a temperature equal to or below 500° C. in terms of the surface temperature. When the cooling stop temperature exceeds 500° C., there is a possibility that transformation on a surface layer is not completed so that the surface layer is transformed into a low-temperature transformation product material in the succeeding cooling step whereby it is no more possible to expect lowering of hardness of the surface layer.

In the second cooling step, air cooling is performed for 10 s or less after completion of the first cooling step.

In this air cooling, the surface layer recovers heat due to heat which a center portion of the hot rolled steel sheet possesses and hence, the surface layer is tempered whereby lowering of hardness of the surface layer is accelerated. Further, air cooling also brings about an advantageous effect that the succeeding cooling of the hot rolled steel sheet at the center in the sheet thickness direction is enhanced. Even when the air cooling time is prolonged exceeding 10 s, the above-mentioned advantageous effect is saturated, and productivity is lowered. Accordingly, air cooling time is limited to a value within 10 s. From a viewpoint of enhancing productivity, the air cooling time is preferably set to 7 s or less. Further, to acquire a tempering effect of the surface layer by recuperation, air cooling time is preferably set to 1 s or more.

In the third cooling step, after completion of the second cooling step, the hot rolled steel sheet is subjected to accelerated cooling at an average cooling rate of 10° C./s or more at the center of the sheet thickness until the temperature at the center of the sheet thickness becomes a temperature in a temperature range from 350° C. or above to a temperature below 600° C. A sheet thickness center temperature control is performed in the accelerated cooling in the third cooling step.

When the average cooling rate at the center of the sheet thickness is less than 10° C./s, polygonal ferrite or pearlite is liable to precipitate so that the hot rolled steel sheet cannot acquire the desired enhancement of strength and the desired enhancement of toughness. Although an upper limit of the average cooling rate at the center of the sheet thickness is decided depending on performance of a cooling device in service, it is desirable to set the upper limit of the average cooling rate to 100° C./s or less which does not bring about deterioration of a shape of the steel sheet such as a warp.

From a viewpoint of securing toughness, the preferred average cooling rate at the center in the sheet thickness is 25° C./s or more. Such cooling can be achieved by cooling (cooling with water) the hot rolled steel sheet by entire surface nuclear boiling at a heat flow rate of 1.5 Gcal/$m^2$ hr or more.

The above-mentioned accelerated cooling is performed until the temperature at the center of sheet thickness becomes a temperature (cooling stop temperature) within a temperature range from 350° C. or above to a temperature below 600° C. When the cooling stop temperature falls outside this range, after winding the hot rolled steel sheet in a coil shape after accelerated cooling, the hot rolled steel sheet cannot be held within a predetermined temperature range for a predetermined time or more and hence, the hot rolled steel sheet cannot secure desired high strength and desired high toughness.

After being subjected to the third cooling step, the hot rolled steel sheet is coiled in a coil shape at a coiling temperature range from 350° C. or above to a temperature below 600° C.

By stopping the accelerated cooling at the above-mentioned cooling stop temperature and by coiling the hot rolled steel sheet in a coil shape at the above-mentioned coiling temperature, the hot rolled steel sheet can be held or kept within the temperature range from 350° C. or above to a temperature below 600° C. for 30 min or more and hence, the enhancement of precipitation is accelerated in the inside of the sheet whereby the hot rolled steel sheet can secure desired high strength and desired high toughness, while hardness of the hot rolled steel sheet at the surface of the hot rolled steel sheet can be lowered due to self annealing.

Second Embodiment

In the second embodiment, after being subjected to finish rolling, the hot rolled steel sheet is subjected to the first cooling step, the second cooling step and the third cooling step sequentially.

In the first cooling step, immediately after the completion of the finish rolling, the hot rolled steel sheet is subjected to accelerated cooling until the surface temperature of the hot rolled steel sheet becomes a temperature not more than $A_{r3}$ transformation temperature and a martensite transformation temperature or more at an average cooling rate of not less than 20° C./s and less than a critical cooling rate of martensite formation. Here, "immediately after the completion of the finish rolling" means that cooling is started within 10 s after completion of the finish rolling.

A surface temperature control is performed in the accelerated cooling in the first cooling step. When the average cooling rate of the surface of the hot rolled steel sheet is less than 20 C.°/s, polygonal ferrite precipitates so that the hot rolled steel sheet cannot achieve the desired enhancement of strength and the desired enhancement of toughness. It is preferable to set an upper limit of the average cooling rate of the surface of the hot rolled steel sheet to a rate less than a martensite formation critical cooling rate (approximately 100° C./s to 500° C./s with respect to the composition range described herein) in view of a purpose of preventing the formation of martensite to lower hardness of the surface layer. The preferred surface average cooling rate is 50 to 100° C./s. In the first cooling step, the cooling stop temperature in the accelerated cooling is set to an $A_{r3}$ transformation temperature or below and above a martensite transformation temperature in terms of a surface temperature. When the cooling stop temperature exceeds the $A_{r3}$ transformation temperature, there exists a possibility that the transformation in a surface layer region is not completed, and the surface layer is transformed into a low-temperature transformed product in the succeeding cooling step whereby it is no more possible to expect the lowering of hardness of the surface layer.

In the second cooling step, after completion of the first cooling step, the hot rolled steel sheet is rapidly cooled until the hot rolled steel sheet at the center of sheet thickness becomes a temperature within a temperature range from 350° C. or above to a temperature below 600° C. It is preferable to set the cooling rate in the rapid cooling to 10° C./s or more in terms of the average cooling rate at the sheet thickness center position. When the average cooling rate at the sheet thickness center position is less than 10° C./s, pearlite is liable to precipitate and hence, the hot rolled steel sheet cannot achieve the desired enhancement of strength and the desired enhancement of toughness. Although an upper limit of the average cooling rate at the center of sheet thickness is decided depending on performance of a cooling device in service, it is desirable to set the upper limit of the average cooling rate to 300° C./s or less which does not bring about deterioration of a shape of the steel sheet such as a warp. From a viewpoint of enhancing toughness, the preferred average cooling rate at the sheet thickness center position is 25° C./s or more. Such cooling can be achieved by cooling (cooling with water) the hot rolled steel sheet by entire surface nuclear boiling at a heat flow rate of 1.0 $Gcal/m^2$ hr or more. The temperature and the cooling rate at the sheet thickness center position are obtained by calculation based on the sheet thickness, the surface temperature and the heat flow rate.

The above-mentioned rapid cooling is performed until the temperature at the center of the sheet thickness becomes a temperature (cooling stop temperature) of 350° C. or above and below 600° C. When the cooling stop temperature is below 350° C., the succeeding normal coiling of the hot rolled steel sheet becomes impossible. On the other hand, when the coiling temperature is 600° C. or more, a grain size becomes coarse so that the hot rolled steel sheet cannot secure high strength and high toughness.

After being subjected to the second cooling step, the hot rolled steel sheet is coiled in a coil shape after the coiling temperature is adjusted to a temperature of 350° C. or above and below 600° C. in terms of a sheet thickness center temperature, and is subjected to the third cooling step where the hot rolled steel sheet at a position of ¼ sheet-thickness to ¾ sheet-thickness in the coil thickness direction is held or kept within a temperature range from 350° C. or above to a temperature below 600° C. for 30 min or more.

When the coiling temperature is below 350° C., the sheet temperature becomes excessively low and hence, it becomes difficult to coil the hot rolled steel sheet into a proper coiling shape. On the other hand, when the coiling temperature becomes high exceeding 600° C., crystal grains become coarse and hence, the hot rolled steel sheet cannot secure desired high strength and the desired high toughness. Accordingly, the coiling temperature is set to the temperature which falls within the range from 350° C. or more to a temperature below 600° C. in terms of the sheet thickness center temperature. The coiling temperature is preferably set to 450 to 550° C.

In the third cooling step, the hot rolled steel sheet coiled in a coil shape is subjected to cooling where the hot rolled steel sheet at least at the position of ¼ sheet thickness to ¾ sheet thickness in the thickness direction of the coil is held or kept within the temperature range from 350° C. or above to a temperature below 600° C. for 30 min or more. By stopping the rapid cooling at the above-mentioned cooling stop temperature and by coiling the hot rolled steel sheet in a coil shape at the above-mentioned coiling temperature, it is possible to perform cooling where the hot rolled steel sheet at the position of ¼ sheet thickness to ¾ sheet thickness in the coil thickness direction is held or kept within the temperature range from 350° C. or above to a temperature below 600° C. for 30 min or more by natural air cooling. However, to hold or keep the hot rolled steel sheet in the temperature region in a more reliable manner, it is preferable to heat the coil or to store the coil in a coil box or the like after the hot rolled steel sheet is coiled in a coil shape.

By making the coil subject to the cooling where the hot rolled steel sheet is held or kept within the temperature range from 350° C. or above to a temperature below 600° C. for 30 min or more, the precipitation is enhanced in the inside of the steel sheet so that the steel sheet can acquire the high strength, while hardness of the steel sheet is lowered in the surface layer of the steel sheet due to self annealing. Accordingly, the hot rolled steel sheet can acquire both the desired high strength and the desired low surface hardness.

The above-mentioned hot rolled steel sheet acquired by the manufacturing method of embodiments of the present invention is the thick-walled high-strength hot rolled steel sheet having excellent hydrogen induced cracking resistance which has the above-mentioned composition, has the single-phase structure (here, single phase structure meaning the structure where 98% or more of the structure is occupied by one phase) which is constituted of a bainitic ferrite phase or a bainite phase in the inside of the sheet, and has high strength of tensile strength: 520 MPa or more, and low surface layer hardness where hardness of the surface layer is 230HV or less. In this specification, "bainitic ferrite phase" also includes acicular ferrite, acicular ferrite. "Surface layer" means a region within 1 mm from the surface of the steel sheet in the sheet thickness direction.

Hereinafter, the present invention is explained in detail in conjunction with examples.

Example 1

Raw steel material (slab)s having the compositions shown in Tables 1 and 2 are subjected to hot rolling under hot rolling conditions shown in Tables 3 and 4. After hot rolling is completed, the hot rolled steel sheets are cooled under cooling conditions shown in Tables 3 and 4, and are coiled in a coil shape at coiling temperatures shown in Tables 3 and 4, and are turned into hot rolled steel sheets (steel strips) having sheet thicknesses shown in Tables 3 and 4.

Specimens are sampled from the obtained hot rolled steel sheet, and the observation of structure, a hardness test, a tensile test, an impact resistance test, circumferential weldability test, and a hydrogen induced cracking test are carried out with respect to these specimens, and surface hardness, tensile property, toughness, circumferential weldability and hydrogen induced cracking resistance are evaluated. The following test methods are used.

(1) Observation of Structure

Structure-observation-use specimens are sampled from the obtained hot rolled steel sheet, cross-sections of the specimens in the rolling direction are polished and etched. The cross section are observed for each specimen with ten visual fields or more at respective positions consisting of a surface layer and a sheet-thickness center position using an optical microscope (magnification: 1000 times), and a kind of the structure is identified and a structural fraction (volume %) are measured.

(2) Hardness Test

Hardness-measurement-use specimens are sampled from the obtained hot rolled steel sheet, a cross-section of the specimen in the rolling direction is polished. Hardness at positions 0.5 mm and 1 mm away from a surface of the specimen in the sheet thickness direction is measured at five points for each position. Arithmetic average values are obtained by calculating the obtained measured values and a higher value is set as surface layer hardness of the hot rolled steel sheet. Here, measurement of hardness is performed using a Vickers hardness meter with a testing force 0.5 kgf.

(3) Tensile Test

A tensile test is carried out with respect to the obtained hot rolled steel sheet such that the longitudinal direction of the specimen is aligned with the direction orthogonal to the rolling direction (C direction) in accordance with provisions of API-5L at a room temperature thus obtaining yield strength YS and tensile strength TS.

(4) Impact Resistance Test

V notch specimens are sampled from a sheet thickness center portion of the obtained hot rolled steel sheet such that the longitudinal direction of the specimen is aligned with the direction orthogonal to the rolling direction (C direction), and a Charpy impact test is carried out in accordance with provisions of JIS Z 2242 thus obtaining absorbed energy (J) at a test temperature of −80° C. The number of specimens is three and an arithmetic average of the obtained absorbed energy values is obtained, and the arithmetic average is set as an absorbed energy value $E_{-80}$(J) of the steel sheet.

(5) Circumferential Weldability Test

The circumferential weldability is evaluated using a y-type weld cracking test. Test plates are sampled from the obtained hot rolled steel sheet, test welding is performed at a room temperature in accordance with the provisions of JIS Z 3158, and the presence or the non-presence of the occurrence of cracks is investigated. The circumferential weldability is evaluated by giving "X:bad" when cracks occur and "o: good" when no cracks occur.

(6) Hydrogen Induced Cracking Test

HIC specimens (size: 100 mm×20 mm) are sampled from the obtained hot rolled steel sheet such that the longitudinal direction of the specimen is aligned with the rolling direction of the steel sheet, and the hydrogen induced cracking resistance is evaluated in accordance with the provisions of TM 0284 of NACE (National Association of Corrosion Engineers). A prescribed A solution is used as a test liquid. After immersing the specimens into the test liquid, CLR (%) is measured. It is determined that no hydrogen induced cracking occurs so that hydrogen induced cracking resistance is favorable when CLR is 0%. The presence or the non-presence of the occurrence of blisters is also investigated.

Obtained results are shown in Tables 5 and 6.

All examples of the present invention turned out to be high-strength hot rolled steel sheets having excellent hydrogen induced cracking resistance, wherein the hot rolled steel sheet has high strength of tensile strength: 520 MPa or more and low surface layer hardness of 230HV or less, and has a large sheet-thickness of 8.7 mm or more. On the other hand, comparison examples which do not fall within the scope of the present invention cannot secure desired properties necessary as a raw material for a high-strength electric-resistance welded steel pipe since the comparison examples cannot secure desired high strength, the comparison examples cannot acquire desired low surface layer hardness, the low temperature toughness is deteriorated, or the circumferential weldability is deteriorated, or hydrogen induced cracking resistance is deteriorated.

Example 2

Raw steel materials having the compositions shown in Tables 7 and 8 are subjected to hot rolling under hot rolling conditions shown in Tables 9 and 10. After hot rolling is completed, the hot rolled steel sheets are cooled under cooling conditions shown in Tables 9 and 10, and are coiled in a coil shape at coiling temperatures shown in Tables 9 and 10, and further, the hot rolled steel sheets are cooled under cooling conditions shown in Tables 9 and 10, are turned into hot rolled steel sheets (steel strips) having sheet thicknesses shown in Tables 9 and 10.

Specimens are sampled from the obtained hot rolled steel sheet, and the observation of structure, a hardness test, a tensile test, an impact resistance test, a circumferential weldability test, and a hydrogen induced cracking test are carried out with respect to these specimens, and a surface hardness, a tensile property, a toughness, a circumferential weldability and a hydrogen induced cracking resistance are evaluated. The following test methods are used.

(1) Observation of Structure

Structure-observation-use specimens are sampled from the obtained hot rolled steel sheet, cross-sections of the specimens in the rolling direction are polished and etched. The cross section are observed for each specimen with ten visual fields or more at respective positions consisting of a surface layer and a sheet-thickness center position using an optical microscope (magnification: 1000 times), and a kind of the structure is identified and a structural fraction (volume %) are measured.

(2) Hardness Test

Hardness-measurement-use specimens are sampled from the obtained hot rolled steel sheet, a cross-section of the specimen in the rolling direction is polished. Hardness at positions 0.5 mm and 1.0 mm away from a surface of the specimen in the sheet thickness direction is measured at five points or more for each position. Arithmetic average values are obtained by calculating the obtained measured values as surface layer hardness of the hot rolled steel sheet. Here, measurement of hardness is performed using a Vickers hardness meter with a testing force 0.3 kgf (2.9N).

(3) Tensile Test

A tensile test is carried out with respect to the obtained hot rolled steel sheet such that the longitudinal direction of the specimen is aligned with the direction orthogonal to the rolling direction (C direction) in accordance with provisions of API-5L at a room temperature thus obtaining yield strength YS and tensile strength TS.

(4) Impact Resistance Test

V notch specimens are sampled from a sheet thickness center portion of the obtained hot rolled steel sheet such that the longitudinal direction of the specimen is aligned with the direction orthogonal to the rolling direction (C direction), and a Charpy impact test is carried out in accordance with provisions of JIS Z 2242 thus obtaining absorbed energy (J) at a test temperature of −80° C. The number of specimens is three and an arithmetic average of the obtained absorbed energy values is obtained, and the arithmetic average is set as an absorbed energy value $vE_{-80}$(J) of the steel sheet.

(5) Circumferential Weldability Test

The circumferential weldability is evaluated using a y-type weld cracking test. Test plates are sampled from the obtained hot rolled steel sheet, test welding is performed at a room temperature in accordance with the provisions of JIS Z 3158, and the presence or the non-presence of the occurrence of cracks is investigated. The circumferential weldability is evaluated by giving "X:bad" when cracks occur and "o: good" when no cracks occur.

(6) Hydrogen Induced Cracking Test

HIC specimens (size: 100 mm×20 mm) are sampled from the obtained hot rolled steel sheet such that the longitudinal direction of the specimen is aligned with the rolling direction of the steel sheet, and the hydrogen induced cracking resistance is evaluated in accordance with the provisions of TM 0284 of NACE. A prescribed A solution is used as a test liquid. After immersing the specimens into the test liquid, CLR (%) is measured. It is determined that no hydrogen induced cracking occurs so that hydrogen induced cracking resistance is favorable when CLR is 0%. The presence or the non-presence of the occurrence of blisters is also investigated.

Obtained results are shown in Tables 11 and 12.

All examples of the present invention are turned out to be high-strength hot rolled steel sheets having excellent hydrogen induced cracking resistance, wherein the hot rolled steel sheet has high strength of tensile strength: 520 MPa or more and low surface layer hardness of 230HV or less, possesses excellent circumferential weldability, and has a large sheet-thickness of 8.7 mm or more. On the other hand, comparison examples which do not fall within the scope of the present invention cannot secure desired properties necessary as a raw material for a high-strength electric-resistance welded steel pipe possessing excellent hydrogen induced cracking resistance of X65 grade or more since the comparison examples cannot secure desired high strength, the comparison examples cannot acquire desired low surface layer hardness, the low temperature toughness is deteriorated, or the circumferential weldability is deteriorated, or hydrogen induced cracking resistance is deteriorated.

TABLE 1

| steel | chemical components (mass %) | | | | | | | |
|---|---|---|---|---|---|---|---|---|
| No. | C | Si | Mn | P | S | Al | Nb | Ti |
| A | 0.045 | 0.19 | 0.98 | 0.006 | 0.0004 | 0.039 | 0.050 | 0.012 |
| B | 0.022 | 0.21 | 1.04 | 0.008 | 0.0007 | 0.033 | 0.052 | 0.010 |
| C | 0.063 | 0.19 | 0.98 | 0.008 | 0.0006 | 0.034 | 0.049 | 0.009 |
| D | 0.041 | 0.21 | 0.53 | 0.007 | 0.0005 | 0.035 | 0.049 | 0.011 |
| E | 0.020 | 0.21 | 1.79 | 0.008 | 0.0003 | 0.037 | 0.048 | 0.009 |
| F | 0.042 | 0.95 | 1.03 | 0.007 | 0.0004 | 0.035 | 0.050 | 0.010 |
| G | 0.041 | 0.22 | 1.07 | 0.006 | 0.0005 | 0.036 | 0.051 | 0.012 |
| H | 0.042 | 0.22 | 1.02 | 0.007 | 0.0003 | 0.033 | 0.001 | 0.010 |
| I | 0.049 | 0.21 | 1.04 | 0.005 | 0.0005 | 0.039 | 0.096 | 0.012 |
| J | 0.042 | 0.22 | 1.03 | 0.006 | 0.0004 | 0.034 | 0.048 | 0.011 |
| K | 0.048 | 0.20 | 0.99 | 0.005 | 0.0004 | 0.036 | 0.049 | 0.001 |
| L | 0.040 | 0.20 | 1.00 | 0.008 | 0.0005 | 0.034 | 0.065 | 0.045 |
| M | 0.040 | 0.20 | 1.00 | 0.008 | 0.0003 | 0.033 | 0.059 | 0.015 |
| N | 0.020 | 0.21 | 1.05 | 0.008 | 0.0005 | 0.030 | 0.091 | 0.048 |

| steel | chemical components (mass %) | | | | | | | |
|---|---|---|---|---|---|---|---|---|
| No. | B | O | V, Mo, Cr, Ni, Cu | Ca, REM, Mg | left side value of formula (1)* | ACR** | Ceq*** | Pcm**** |
| A | 0.0001 | 0.0020 | V: 0.68, Cr: 0.23, Cu: 0.17, Ni: 0.16 | Ca: 0.0017 | 0.822 | 1.796 | 0.290 | 0.130 |
| B | 0.0002 | 0.0010 | V: 0.70, Cr: 0.25, Cu: 0.16, Ni: 0.17 | Ca: 0.0019 | 1.636 | 1.683 | 0.281 | 0.112 |
| C | 0.0002 | 0.0011 | Cu: 0.16, Ni: 0.16 | Ca: 0.0022 | 0.532 | 2.250 | 0.248 | 0.130 |
| D | 0.0002 | 0.0010 | Mo: 0.20 | Ca: 0.0022 | 0.866 | 2.774 | 0.169 | 0.089 |
| E | 0.0002 | 0.0011 | — | Ca: 0.0018 | 1.650 | 3.586 | 0.318 | 0.118 |
| F | 0.0002 | 0.0017 | — | Ca: 0.0019 | 0.833 | 2.348 | 0.214 | 0.126 |
| G | 0.0004 | 0.0014 | — | Ca: 0.0020 | 0.915 | 2.214 | 0.219 | 0.104 |
| H | 0.0002 | 0.0011 | — | Ca: 0.0018 | 0.250 | 3.586 | 0.212 | 0.101 |
| I | 0.0002 | 0.0016 | — | Ca: 0.0019 | 1.224 | 1.947 | 0.222 | 0.109 |
| J | 0.0002 | 0.0014 | — | Ca: 0.0110 | 0.833 | 17.492 | 0.214 | 0.102 |
| K | 0.0002 | 0.0020 | — | Ca: 0.0021 | 0.531 | 2.388 | 0.213 | 0.105 |

TABLE 1-continued

| | | | | | | | | |
|---|---|---|---|---|---|---|---|---|
| L | 0.0002 | 0.0010 | — | Ca: 0.0021 | 1.938 | 2.635 | 0.207 | 0.098 |
| M | 0.0002 | 0.0021 | — | REM: 0.0033 | 1.113 | 5.390 | 0.207 | 0.098 |
| N | 0.0002 | 0.0016 | — | Ca: 0.0024 | 4.675 | 2.580 | 0.198 | 0.084 |

*left side value of formula (1) = (Ti + Nb/2)/C
**ACR = {Ca − O × (0.18 + 130 Ca}/1.25 S
***Ceq = C + Mn/6 + (Cr + Mo + V)/5 + (Cu + Ni)/15
****Pcm = C + Si/30 + (Mn + Cu + Cr)/20 + Ni/60 + Mo/15 + V/10 + 5 B

TABLE 2

| steel | chemical components (mass %) | | | | | | | |
|---|---|---|---|---|---|---|---|---|
| No. | C | Si | Mn | P | S | Al | Nb | Ti |
| O | 0.052 | 0.20 | 1.81 | 0.008 | 0.0004 | 0.034 | 0.059 | 0.034 |
| P | 0.040 | 0.30 | 1.90 | 0.014 | 0.0036 | 0.035 | 0.059 | 0.028 |
| Q | 0.091 | 0.20 | 1.21 | 0.008 | 0.0005 | 0.036 | 0.046 | 0.023 |
| R | 0.046 | 1.09 | 1.02 | 0.006 | 0.0004 | 0.034 | 0.046 | 0.010 |
| S | 0.043 | 0.22 | 1.05 | 0.007 | 0.0005 | 0.036 | 0.112 | 0.009 |
| T | 0.051 | 0.20 | 0.98 | 0.008 | 0.0004 | 0.036 | 0.046 | 0.011 |
| U | 0.048 | 0.19 | 0.99 | 0.007 | 0.0003 | 0.035 | 0.049 | 0.063 |
| V | 0.048 | 0.19 | 0.99 | 0.038 | 0.0003 | 0.035 | 0.049 | 0.063 |
| W | 0.048 | 0.19 | 0.99 | 0.007 | 0.0056 | 0.035 | 0.049 | 0.063 |
| X | 0.060 | 0.21 | 1.34 | 0.014 | 0.0021 | 0.041 | 0.018 | 0.012 |
| Y | 0.043 | 0.02 | 1.09 | 0.008 | 0.0002 | 0.039 | 0.050 | 0.011 |
| Z | 0.041 | 0.02 | 0.27 | 0.008 | 0.0006 | 0.042 | 0.050 | 0.010 |
| AA | 0.041 | 0.30 | 1.02 | 0.007 | 0.0005 | 0.035 | 0.049 | 0.010 |
| AB | 0.020 | 0.21 | 1.62 | 0.008 | 0.0006 | 0.037 | 0.048 | 0.012 |

| steel | chemical components (mass %) | | | | | | | |
|---|---|---|---|---|---|---|---|---|
| No. | B | O | V, Mo, Cr, Ni, Cu | Ca, REM, Mg | left side value of formula (1)* | ACR** | Ceq*** | Pcm**** |
| O | 0.0002 | 0.0017 | Cr: 0.20 | Ca: 0.0022 | 1.221 | 2.816 | 0.394 | 0.160 |
| P | 0.0002 | 0.0020 | V: 0.045, Cu: 0.28, Ni: 0.30 | Ca: 0.0019 | 1.438 | 0.232 | 0.404 | 0.170 |
| Q | 0.0002 | 0.0015 | — | Ca: 0.0022 | 0.505 | 2.402 | 0.293 | 0.159 |
| R | 0.0002 | 0.0014 | — | Ca: 0.0021 | 0.717 | 2.932 | 0.216 | 0.134 |
| S | 0.0002 | 0.0012 | — | Ca: 0.0020 | 1.512 | 2.355 | 0.218 | 0.104 |
| T | 0.0008 | 0.0011 | — | Ca: 0.0023 | 0.667 | 3.546 | 0.214 | 0.111 |
| U | 0.0002 | 0.0013 | — | Ca: 0.0019 | 1.823 | 3.586 | 0.213 | 0.105 |
| V | 0.0002 | 0.0013 | — | Ca: 0.0019 | 1.823 | 3.586 | 0.213 | 0.105 |
| W | 0.0002 | 0.0013 | — | Ca: 0.0019 | 1.823 | 0.192 | 0.213 | 0.105 |
| X | 0.0002 | 0.0011 | V: 0.042 | Ca: 0.0021 | 0.350 | 0.610 | 0.292 | 0.139 |
| Y | 0.0002 | 0.0013 | — | — | 0.837 | −0.936 | 0.225 | 0.099 |
| Z | 0.0002 | 0.0015 | — | Ca: 0.0020 | 0.854 | 1.787 | 0.086 | 0.056 |
| AA | 0.0002 | 0.0017 | — | Mg: 0.0019 | 0.841 | −0.490 | 0.211 | 0.103 |
| AB | 0.0002 | 0.0014 | — | Ca: 0.0014, Mg: 0.0011 | 1.800 | 1.191 | 0.290 | 0.109 |

*left side value of formula (1) = (Ti + Nb/2)/C
**ACR = {Ca − O × (0.18 + 130 Cal}/1.25 S
***Ceq = C + Mn/6 + (Cr + Mo + V)/5 + (Cu + Ni)/15
****Pcm = C + Si/30 + (Mn + Cu + Cr)/20 + Ni/60 + Mo/15 + V/10 + 5 B

TABLE 3

| | | hot rolling condition | | | | | | | third cooling step | | | | |
|---|---|---|---|---|---|---|---|---|---|---|---|---|---|
| | | | | finish | first cooling step | | second | average | | | | | |
| steel sheet No. | steel No. | heating temperature (° C.) | cumulative reduction rate at 1000° C. or below (%) | rolling completion temperature (° C.) | average surface cooling rate (° C./s) | cooling stop surface temperature (° C.) | cooling step air cooling time (s) | cooling rate at center of sheet thickness (° C./s) | cooling stop temperature* (° C.) | coiling coiling temperature (° C.) | sheet thickness (mm) | remarks |
| 1 | A | 1200 | 60 | 805 | 190 | 350 | 3.0 | 43 | 540 | 525 | 15.9 | present invention example |
| 2 | A | 1150 | 60 | 820 | 320 | 135 | 1.5 | 6 | 460 | 440 | 19.1 | comparison example |
| 3 | A | 1250 | 60 | 815 | 150 | 440 | 4.5 | 29 | 640 | 610 | 19.1 | comparison example |
| 4 | A | 1100 | 60 | 780 | 75 | 620 | 2.5 | 42 | 485 | 465 | 15.9 | comparison example |
| 5 | A | 1200 | 60 | 770 | 220 | 320 | — | 63 | 515 | 495 | 12.7 | comparison example |
| 6 | A | 1250 | 60 | 800 | 240 | 360 | 1.5 | 13 | 470 | 450 | 25.4 | present invention example |
| 7 | A | 1250 | 60 | 805 | 230 | 415 | 5.5 | 23 | 535 | 520 | 20.6 | present invention example |

TABLE 3-continued

| steel sheet No. | steel No. | heating temperature (° C.) | hot rolling condition: cumulative reduction rate at 1000° C. or below (%) | hot rolling condition: finish rolling completion temperature (° C.) | first cooling step: average surface cooling rate (° C./s) | first cooling step: cooling stop surface temperature (° C.) | second cooling step: air cooling time (s) | third cooling step: average cooling rate at center of sheet thickness (° C./s) | third cooling step: cooling stop temperature* (° C.) | third cooling step: coiling coiling temperature (° C.) | sheet thickness (mm) | remarks |
|---|---|---|---|---|---|---|---|---|---|---|---|---|
| 8 | A | 1200 | 60 | 795 | 290 | 370 | 1.5 | 7 | 590 | 575 | 19.1 | comparison example |
| 9 | A | 1150 | 60 | 800 | 120 | 605 | 1.5 | 44 | 530 | 520 | 15.9 | comparison example |
| 10 | A | 1200 | 60 | 790 | 250 | 335 | 2.0 | 43 | 220 | 205 | 15.9 | comparison example |
| 11 | A | 1150 | 60 | 790 | 220 | 385 | 3.5 | 66 | 520 | 505 | 12.7 | present invention example |
| 12 | B | 1200 | 60 | 785 | 190 | 400 | 4.0 | 28 | 510 | 495 | 19.1 | present invention example |
| 13 | C | 1150 | 60 | 780 | 360 | 220 | 3.5 | 29 | 425 | 410 | 19.1 | present invention example |
| 14 | D | 1250 | 60 | 815 | 200 | 410 | 3.0 | 43 | 515 | 500 | 15.9 | present invention example |
| 15 | E | 1250 | 60 | 820 | 240 | 375 | 3.0 | 20 | 485 | 465 | 19.1 | present invention example |
| 16 | F | 1150 | 60 | 800 | 190 | 415 | 3.0 | 43 | 450 | 430 | 15.9 | present invention example |
| 17 | G | 1200 | 60 | 815 | 230 | 370 | 3.0 | 64 | 475 | 460 | 12.7 | present invention example |
| 18 | H | 1150 | 60 | 805 | 190 | 405 | 3.0 | 42 | 505 | 490 | 15.9 | present invention example |
| 19 | I | 1250 | 60 | 780 | 260 | 360 | 3.0 | 30 | 565 | 545 | 19.1 | present invention example |

*temperature at the center position of sheet thickness

TABLE 4

| steel sheet No. | steel No. | heating temperature (° C.) | hot rolling condition: cumulative reduction rate at 1000° C. or below (%) | hot rolling condition: finish rolling completion temperature (° C.) | first cooling step: average surface cooling rate (° C./s) | first cooling step: cooling stop surface temperature (° C.) | second cooling step: air cooling time (s) | third cooling step: average cooling rate at center of sheet thickness (° C./s) | third cooling step: cooling stop temperature* (° C.) | third cooling step: coiling coiling temperature (° C.) | sheet thickness (mm) | remarks |
|---|---|---|---|---|---|---|---|---|---|---|---|---|
| 20 | J | 1200 | 60 | 770 | 290 | 345 | 3.0 | 43 | 495 | 475 | 15.9 | comparison example |
| 21 | K | 1200 | 60 | 790 | 290 | 455 | 3.0 | 44 | 515 | 495 | 15.9 | present invention example |
| 22 | L | 1200 | 60 | 800 | 250 | 400 | 3.0 | 42 | 530 | 505 | 15.9 | present invention example |
| 23 | M | 1150 | 60 | 815 | 180 | 405 | 3.0 | 44 | 510 | 485 | 15.9 | present invention example |
| 24 | N | 1200 | 60 | 805 | 190 | 365 | 3.0 | 43 | 500 | 480 | 15.9 | comparison example |
| 25 | O | 1200 | 60 | 780 | 260 | 320 | 3.0 | 41 | 535 | 510 | 15.9 | comparison example |
| 26 | P | 1250 | 60 | 820 | 190 | 340 | 3.0 | 44 | 495 | 475 | 15.9 | comparison example |
| 27 | Q | 1200 | 60 | 815 | 240 | 345 | 3.0 | 43 | 520 | 500 | 15.9 | comparison example |
| 28 | R | 1200 | 60 | 780 | 180 | 360 | 3.0 | 44 | 495 | 470 | 15.9 | comparison example |
| 29 | S | 1150 | 60 | 805 | 200 | 345 | 3.0 | 45 | 515 | 490 | 15.9 | comparison example |
| 30 | T | 1150 | 60 | 810 | 230 | 365 | 3.0 | 41 | 540 | 515 | 15.9 | comparison example |
| 31 | U | 1200 | 60 | 795 | 260 | 325 | 3.0 | 41 | 530 | 505 | 15.9 | comparison example |
| 32 | V | 1150 | 60 | 815 | 170 | 405 | 3.0 | 42 | 505 | 480 | 15.9 | comparison example |
| 33 | W | 1200 | 60 | 820 | 190 | 410 | 3.0 | 45 | 520 | 500 | 15.9 | comparison example |
| 34 | X | 1120 | 60 | 840 | 80 | 675 | 3.0 | 12 | 600 | 570 | 19.1 | comparison example |
| 35 | Y | 1200 | 60 | 800 | 210 | 440 | 3.0 | 40 | 510 | 510 | 15.9 | present invention example |
| 36 | Z | 1200 | 60 | 815 | 230 | 470 | 3.0 | 42 | 535 | 490 | 15.9 | comparison example |
| 37 | AA | 1200 | 60 | 800 | 170 | 410 | 3.0 | 43 | 450 | 420 | 15.9 | present invention example |
| 38 | AB | 1200 | 60 | 820 | 240 | 380 | 3.0 | 20 | 480 | 450 | 19.1 | present invention example |

*temperature at the center position of sheet thickness

TABLE 5

| steel sheet No. | steel No. | structure: surface layer kind*; fraction (area %) | structure: center of sheet thickness kind*; fraction (area %) | structure: hardness surface layer hardness HV | tensile strength: YS (MPa) | tensile strength: TS (MPa) | toughness $vE_{-80}$ (J) | circumferential weldability | HIC resistance: CLR (%) | HIC resistance: presence or no presence of occurrence of blister | remarks |
|---|---|---|---|---|---|---|---|---|---|---|---|
| 1 | A | M: 60, BF: 40 | BF:100 | 206 | 517 | 558 | 229 | ○ | 0 | no presence | present invention example |
| 2 | A | M: 65, BF: 35 | F: 80, P: 20 | 243 | 512 | 569 | 55 | ○ | 10 | presence | comparison example |
| 3 | A | M: 80, BF: 20 | F: 85, P: 15 | 234 | 516 | 578 | 111 | ○ | 10 | no presence | comparison example |

TABLE 5-continued

| steel sheet No. | steel No. | structure: surface layer kind*; fraction (area %) | structure: center of sheet thickness kind*; fraction (area %) | hardness surface layer hardness HV | tensile strength YS (MPa) | tensile strength TS (MPa) | toughness $vE_{-80}$ (J) | circumferential weldability | HIC resistance: CLR (%) | HIC resistance: presence or no presence of occurrence of blister | remarks |
|---|---|---|---|---|---|---|---|---|---|---|---|
| 4 | A | M: 5, BF: 95 | BF: 100 | 252 | 521 | 587 | 116 | ○ | 5 | presence | comparison example |
| 5 | A | M: 80, BF: 20 | BF: 100 | 243 | 522 | 588 | 235 | ○ | 5 | presence | comparison example |
| 6 | A | M: 65, BF: 35 | BF: 100 | 208 | 513 | 561 | 264 | ○ | 0 | no presence | present invention example |
| 7 | A | M: 70, BF: 30 | BF: 100 | 206 | 509 | 567 | 270 | ○ | 0 | no presence | present invention example |
| 8 | A | M: 80, BF: 20 | F: 85, P: 15 | 235 | 524 | 578 | 49 | ○ | 5 | no presence | comparison example |
| 9 | A | M: 70, BF: 30 | BF: 100 | 254 | 526 | 575 | 97 | ○ | 10 | presence | comparison example |
| 10 | A | M: 5, BF: 95 | BF: 100 | 261 | 519 | 574 | 265 | ○ | 10 | presence | comparison example |
| 11 | A | M: 55, BF: 45 | BF: 100 | 196 | 524 | 581 | 245 | ○ | 0 | no presence | present invention example |
| 12 | B | M: 60, BF: 40 | BF: 100 | 203 | 531 | 621 | 268 | ○ | 0 | no presence | present invention example |
| 13 | C | M: 60, BF: 40 | BF: 100 | 218 | 519 | 599 | 249 | ○ | 0 | no presence | present invention example |
| 14 | D | M: 60, BF: 40 | BF: 100 | 206 | 516 | 592 | 204 | ○ | 0 | no presence | present invention example |
| 15 | E | M: 65, BF: 35 | BF: 100 | 211 | 541 | 589 | 199 | ○ | 0 | no presence | present invention example |
| 16 | F | M: 60, BF: 40 | BF: 100 | 197 | 502 | 539 | 274 | ○ | 0 | no presence | present invention example |
| 17 | G | M: 60, BF: 40 | BF: 100 | 213 | 521 | 574 | 262 | ○ | 0 | no presence | present invention example |
| 18 | H | M: 55, BF: 35 | BF: 100 | 206 | 530 | 602 | 209 | ○ | 0 | no presence | present invention example |
| 19 | I | M: 70, BF: 30 | BF: 100 | 215 | 563 | 611 | 299 | ○ | 0 | no presence | present invention example |

*BF: bainitic ferrite, B: bainite, M: martensite, F: ferrite, P: pearlite

TABLE 6

| steel sheet No. | steel No. | structure: surface layer kind*; fraction (area %) | structure: center of sheet thickness kind*; fraction (area %) | hardness surface layer hardness HV | tensile strength YS (MPa) | tensile strength TS (MPa) | toughness $vE_{-80}$ (J) | circumferential weldability | HIC resistance: CLR (%) | HIC resistance: presence or no presence of occurrence of blister | remarks |
|---|---|---|---|---|---|---|---|---|---|---|---|
| 20 | J | M: 70, BF: 30 | BF: 100 | 246 | 527 | 598 | 8 | ○ | 10 | presence | comparison example |
| 21 | K | M: 70, BF: 30 | BF: 100 | 218 | 504 | 562 | 244 | ○ | 0 | no presence | present invention example |
| 22 | L | M: 65, BF: 35 | BF: 100 | 202 | 563 | 629 | 213 | ○ | 0 | no presence | present invention example |
| 23 | M | M: 70, BF: 30 | BF: 100 | 216 | 514 | 587 | 264 | ○ | 0 | no presence | present invention example |
| 24 | N | M: 60, BF: 40 | BF: 100 | 182 | 453 | 513 | 202 | x | 5 | no presence | comparison example |
| 25 | O | M: 75, BF: 25 | BF: 100 | 261 | 573 | 647 | 10 | x | 10 | presence | comparison example |
| 26 | P | M: 70, BF: 30 | BF: 100 | 237 | 548 | 625 | 226 | ○ | 10 | no presence | comparison example |
| 27 | Q | M: 65, BF: 35 | BF: 100 | 243 | 587 | 675 | 26 | x | 15 | presence | comparison example |
| 28 | R | M: 90, BF: 10 | BF: 100 | 237 | 541 | 592 | 11 | ○ | 5 | no presence | comparison example |
| 29 | S | M: 60, BF: 40 | BF: 100 | 218 | 561 | 634 | 22 | x | 10 | no presence | comparison example |
| 30 | T | M: 65, BF: 35 | BF: 100 | 223 | 527 | 598 | 29 | x | 10 | no presence | comparison example |
| 31 | U | M: 70, BF: 30 | BF: 100 | 210 | 574 | 652 | 33 | ○ | 5 | no presence | comparison example |
| 32 | V | M: 65, BF: 35 | BF: 100 | 241 | 541 | 593 | 17 | x | 10 | presence | comparison example |
| 33 | W | M: 70, BF: 30 | BF: 100 | 228 | 513 | 576 | 24 | ○ | 15 | no presence | comparison example |
| 34 | X | M: 75, BF: 25 | BF: 100 | 251 | 508 | 661 | 12 | ○ | 10 | no presence | comparison example |
| 35 | Y | BF: 100 | BF: 100 | 219 | 530 | 599 | 198 | ○ | 0 | no presence | present invention example |
| 36 | Z | M: 70, BF: 30 | BF: 100 | 198 | 431 | 482 | 219 | ○ | 5 | no presence | comparison example |
| 37 | AA | M: 60, BF: 40 | BF: 100 | 195 | 505 | 542 | 271 | ○ | 0 | no presence | present invention example |
| 38 | AB | M: 70, BF: 30 | BF: 100 | 209 | 528 | 575 | 198 | ○ | 0 | no presence | present invention example |

*BF: bainitic ferrite, B: bainite, M: martensite, F: ferrite, P: pearlite

TABLE 7

| steel | chemical components (mass %) | | | | | | | |
|---|---|---|---|---|---|---|---|---|
| No. | C | Si | Mn | P | S | Al | Nb | Ti |
| A | 0.049 | 0.20 | 0.99 | 0.006 | 0.0003 | 0.040 | 0.050 | 0.010 |
| B | 0.023 | 0.19 | 1.03 | 0.007 | 0.0006 | 0.035 | 0.051 | 0.013 |
| C | 0.069 | 0.19 | 1.02 | 0.008 | 0.0005 | 0.036 | 0.053 | 0.008 |
| D | 0.040 | 0.21 | 0.57 | 0.006 | 0.0006 | 0.059 | 0.047 | 0.012 |
| E | 0.052 | 0.20 | 1.39 | 0.007 | 0.0004 | 0.033 | 0.049 | 0.011 |
| F | 0.042 | 0.97 | 1.04 | 0.007 | 0.0003 | 0.035 | 0.052 | 0.009 |

TABLE 7-continued

| | | | | | | | | |
|---|---|---|---|---|---|---|---|---|
| G | 0.039 | 0.21 | 0.98 | 0.008 | 0.0004 | 0.037 | 0.050 | 0.010 |
| H | 0.040 | 0.20 | 0.99 | 0.006 | 0.0004 | 0.031 | 0.031 | 0.009 |
| I | 0.056 | 0.21 | 1.06 | 0.006 | 0.0004 | 0.037 | 0.097 | 0.008 |
| J | 0.043 | 0.23 | 1.01 | 0.006 | 0.0005 | 0.036 | 0.046 | 0.010 |
| K | 0.048 | 0.20 | 1.07 | 0.007 | 0.0004 | 0.034 | 0.050 | 0.013 |
| L | 0.042 | 0.19 | 1.01 | 0.006 | 0.0005 | 0.038 | 0.063 | 0.012 |
| M | 0.041 | 0.19 | 1.02 | 0.007 | 0.0003 | 0.034 | 0.060 | 0.014 |

| steel No. | chemical components (mass %) B | O | V, Mo, Cr, Ni, Cu | Ca, REM, Mg | left side value of formula (1)* | ACR** | Ceq*** | Pcm**** |
|---|---|---|---|---|---|---|---|---|
| A | 0.0001 | 0.0019 | V: 0.071, Cr: 0.23, Cu: 0.16, Ni: 0.17 | Ca: 0.0018 | 0.714 | 2.702 | 0.296 | 0.135 |
| B | 0.0002 | 0.0011 | V: 0.068, Cr: 0.24, Cu: 0.16, Ni: 0.17 | Ca: 0.0020 | 1.674 | 2.021 | 0.278 | 0.110 |
| C | 0.0002 | 0.0016 | Mo: 0.19, Cu: 0.17, Ni: 0.16 | Ca: 0.0022 | 0.500 | 2.327 | 0.299 | 0.138 |
| D | 0.0002 | 0.0017 | — | Ca: 0.0021 | 0.888 | 1.773 | 0.135 | 0.076 |
| E | 0.0002 | 0.0011 | — | Ca: 0.0017 | 0.683 | 2.518 | 0.284 | 0.128 |
| F | 0.0002 | 0.0013 | — | Ca: 0.0019 | 0.833 | 3.586 | 0.215 | 0.126 |
| G | 0.0004 | 0.0015 | — | Ca: 0.0019 | 0.897 | 2.290 | 0.202 | 0.095 |
| H | 0.0002 | 0.0013 | — | Ca: 0.0018 | 0.250 | 2.524 | 0.205 | 0.096 |
| I | 0.0002 | 0.0018 | — | Ca: 0.0018 | 1.009 | 2.110 | 0.233 | 0.116 |
| J | 0.0002 | 0.0017 | — | Ca: 0.0111 | 0.767 | 12.847 | 0.211 | 0.101 |
| K | 0.0002 | 0.0021 | — | Ca: 0.0020 | 0.792 | 2.152 | 0.226 | 0.108 |
| L | 0.0002 | 0.0016 | — | Ca: 0.0021 | 1.036 | 2.200 | 0.210 | 0.099 |
| M | 0.0002 | 0.0022 | — | REM: 0.0031 | 1.073 | 4.846 | 0.211 | 0.099 |

*left side value of formula (1) = (Ti + Nb/2)/C

**ACR = {Ca − O × ((0.18 + 130 Cal}/1.25 S

***Ceq = C + Mn/6 + (Cr + Mo + V)/5 + (Cu + Ni)/15

****Pcm = C + Si/30 + (Mn + Cu + Cr)/20 + Ni/60 + Mo/15 + V/10 + 5 B

TABLE 8

| steel No. | chemical components (mass %) C | Si | Mn | P | S | Al | Nb | Ti |
|---|---|---|---|---|---|---|---|---|
| N | 0.021 | 0.20 | 1.06 | 0.007 | 0.0004 | 0.034 | 0.092 | 0.049 |
| O | 0.054 | 0.20 | 1.82 | 0.007 | 0.0003 | 0.036 | 0.061 | 0.036 |
| P | 0.041 | 0.31 | 1.93 | 0.016 | 0.0037 | 0.037 | 0.058 | 0.030 |
| Q | 0.089 | 0.20 | 1.23 | 0.006 | 0.0004 | 0.038 | 0.047 | 0.025 |
| R | 0.044 | 1.09 | 1.01 | 0.007 | 0.0003 | 0.036 | 0.048 | 0.011 |
| S | 0.042 | 0.23 | 1.03 | 0.008 | 0.0004 | 0.034 | 0.109 | 0.011 |
| T | 0.049 | 0.19 | 0.99 | 0.006 | 0.0005 | 0.036 | 0.048 | 0.009 |
| U | 0.046 | 0.18 | 1.01 | 0.007 | 0.0004 | 0.035 | 0.051 | 0.067 |
| V | 0.047 | 0.19 | 0.99 | 0.041 | 0.0004 | 0.037 | 0.053 | 0.012 |
| W | 0.048 | 0.20 | 0.96 | 0.007 | 0.0050 | 0.033 | 0.048 | 0.009 |
| X | 0.043 | 0.02 | 1.09 | 0.008 | 0.0002 | 0.039 | 0.050 | 0.011 |
| Y | 0.041 | 0.30 | 1.02 | 0.007 | 0.0005 | 0.035 | 0.049 | 0.010 |
| Z | 0.020 | 0.21 | 1.62 | 0.008 | 0.0006 | 0.037 | 0.048 | 0.012 |

| steel No. | chemical components (mass %) B | O | V, Mo, Cr, Ni, Cu | Ca, REM, Mg | left side value of formula (1)* | ACR** | Ceq*** | Pcm**** |
|---|---|---|---|---|---|---|---|---|
| N | 0.0002 | 0.0014 | — | Ca: 0.0023 | 4.524 | 3.259 | 0.199 | 0.082 |
| O | 0.0002 | 0.0019 | Cr: 0.20 | Ca: 0.0023 | 1.231 | 3.706 | 0.397 | 0.162 |
| P | 0.0002 | 0.0021 | V: 0.043, Cu: 0.28, Ni: 0.30 | Ca: 0.0017 | 1.439 | 0.185 | 0.410 | 0.171 |
| Q | 0.0002 | 0.0016 | — | Ca: 0.0023 | 0.545 | 3.067 | 0.294 | 0.157 |
| R | 0.0002 | 0.0015 | — | Ca: 0.0021 | 0.795 | 3.788 | 0.212 | 0.131 |
| S | 0.0002 | 0.0013 | — | Ca: 0.0020 | 1.560 | 2.856 | 0.214 | 0.101 |
| T | 0.0007 | 0.0010 | — | Ca: 0.0021 | 0.673 | 2.635 | 0.214 | 0.105 |
| U | 0.0002 | 0.0016 | — | Ca: 0.0016 | 2.011 | 1.958 | 0.214 | 0.103 |
| V | 0.0002 | 0.0015 | — | Ca: 0.0014 | 0.819 | 1.714 | 0.212 | 0.103 |

TABLE 8-continued

| | | | | | | | | |
|---|---|---|---|---|---|---|---|---|
| W | 0.0002 | 0.0013 | — | Ca: 0.0017 | 0.688 | 0.181 | 0.208 | 0.103 |
| X | 0.0002 | 0.0013 | — | — | 0.837 | −0.936 | 0.225 | 0.099 |
| Y | 0.0002 | 0.0017 | — | Mg: 0.0019 | 0.841 | −0.490 | 0.211 | 0.103 |
| Z | 0.0002 | 0.0014 | — | Ca: 0.0014, Mg: 0.0011 | 1.800 | 1.191 | 0.290 | 0.109 |

*left side value of formula (1) = (Ti + Nb/2)/C

**ACR = {Ca − O × ((0.18 + 130 Cal}/1.25 S

***Ceq = C + Mn/6 + (Cr + Mo + V)/5 + (Cu + Ni)/15

****Pcm = C + Si/30 + (Mn + Cu + Cr)/20 + Ni/60 + Mo/15 + V/10 + 5 B

TABLE 9

| | | | hot rolling condition | | first cooling step | | | | |
|---|---|---|---|---|---|---|---|---|---|
| steel sheet No | steel No. | heating temperature (° C.) | cumulative reduction rate at 1000° C. or below (%) | finish rolling completion temperature (° C.) | martensite formation critical cooling rate (° C./s) | average surface cooling rate (° C./s) | cooling stop surface temperature (° C.) | $Ar_{3**}$ ((C.) | Ms (° C.)*** ((C.) |
| 1 | A | 1200 | 60 | 800 | 350 | 200 | 510 | 800 | 498 |
| 2 | A | 1200 | 60 | 815 | 350 | 315 | 515 | 800 | 498 |
| 3 | A | 1150 | 60 | 820 | 350 | 100 | 565 | 800 | 498 |
| 4 | A | 1200 | 60 | 795 | 350 | 15 | 590 | 800 | 498 |
| 5 | A | 1200 | 60 | 780 | 350 | 550 | 520 | 800 | 498 |
| 6 | A | 1250 | 60 | 805 | 350 | 220 | 515 | 800 | 498 |
| 7 | A | 1150 | 60 | 810 | 350 | 180 | 500 | 800 | 498 |
| 8 | A | 1150 | 60 | 810 | 350 | 190 | 505 | 800 | 498 |
| 9 | A | 1250 | 60 | 805 | 350 | 260 | 520 | 800 | 498 |
| 10 | A | 1200 | 60 | 805 | 350 | 270 | 85 | 800 | 498 |
| 11 | A | 1250 | 60 | 795 | 350 | 260 | 515 | 800 | 498 |
| 12 | A | 1200 | 60 | 785 | 350 | 240 | 530 | 800 | 498 |
| 13 | B | 1150 | 60 | 790 | 500 | 180 | 520 | 804 | 509 |
| 14 | C | 1200 | 60 | 785 | 300 | 280 | 500 | 780 | 487 |
| 15 | D | 1200 | 60 | 815 | 400 | 260 | 535 | 852 | 523 |
| 16 | E | 1200 | 60 | 805 | 350 | 180 | 505 | 783 | 490 |
| 17 | F | 1150 | 60 | 800 | 400 | 230 | 520 | 814 | 507 |
| 18 | G | 1250 | 60 | 810 | 400 | 240 | 535 | 820 | 510 |
| 19 | H | 1200 | 60 | 815 | 400 | 180 | 520 | 818 | 509 |
| 20 | I | 1250 | 60 | 795 | 300 | 250 | 520 | 808 | 499 |

| | second cooling step | | | third cooling step | | |
|---|---|---|---|---|---|---|
| steel sheet No | air cooling time (s) | average cooling rate at center of sheet thickness ((C./s) | cooling stop temperature* ((C.) | coiling temperature ((C.) | keep time between 350 and 600° C. (min) | remarks |
| 1 | 0.3 | 55 | 540 | 525 | 30 or more | present invention example |
| 2 | 0.3 | 24 | 460 | 440 | 30 or more | present invention example |
| 3 | 0.3 | 27 | 640 | 610 | 30 or more | comparison example |
| 4 | 0.3 | 56 | 485 | 465 | 30 or more | comparison example |
| 5 | 0.3 | 84 | 515 | 495 | 30 or more | comparison example |
| 6 | 0.3 | 54 | 470 | 455 | 30 or more | present invention example |
| 7 | 0.3 | 23 | 320 | 300 | 0 | comparison example |
| 8 | 0.3 | 53 | 530 | 510 | 30 or more | present invention example |
| 9 | 0.3 | 21 | 590 | 575 | 30 or more | present invention example |
| 10 | 0.3 | 57 | 530 | 520 | 30 or more | comparison example |
| 11 | 0.3 | 21 | 560 | 550 | 30 or more | present invention example |
| 12 | 0.3 | 87 | 520 | 505 | 30 or more | present invention example |
| 13 | 0.3 | 29 | 510 | 495 | 30 or more | present invention example |
| 14 | 0.3 | 27 | 425 | 410 | 30 or more | present invention example |
| 15 | 0.3 | 54 | 515 | 500 | 30 or more | present invention example |
| 16 | 0.3 | 27 | 485 | 465 | 30 or more | present invention example |
| 17 | 0.3 | 60 | 450 | 430 | 30 or more | present invention example |
| 18 | 0.3 | 84 | 475 | 460 | 30 or more | present invention example |
| 19 | 0.3 | 59 | 505 | 490 | 30 or more | present invention example |
| 20 | 0.3 | 31 | 565 | 545 | 30 or more | present invention example |

*temperature at the center position of sheet thickness

**value calculated using $Ar_3$(° C.) = 910-310C—80Mn—20Cu—15Cr—55Ni—80Mo

***value calculated using Ms(° C.) = 561-474C—33Mn—17Ni—17Cr—21Mo

TABLE 10

| steel sheet No | steel No. | heating temperature ((C.) | hot rolling condition: cumulative reduction rate at 1000° C. or below (%) | hot rolling condition: finish rolling completion temperature ((C.) | first cooling step: martensite formation critical cooling rate ((C./s) | first cooling step: average surface cooling rate ((C./s) | first cooling step: cooling stop surface temperature ((C.) | $Ar_3$** ((C.) | Ms (° C.)*** ((C.) |
|---|---|---|---|---|---|---|---|---|---|
| 21 | J | 1250 | 60 | 790 | 300 | 270 | 530 | 816 | 507 |
| 22 | K | 1150 | 60 | 785 | 350 | 240 | 520 | 810 | 503 |
| 23 | L | 1200 | 60 | 805 | 300 | 260 | 535 | 816 | 508 |
| 24 | M | 1200 | 60 | 805 | 300 | 200 | 540 | 816 | 508 |
| 25 | N | 1150 | 60 | 815 | 500 | 270 | 530 | 819 | 516 |
| 26 | O | 1250 | 60 | 795 | 400 | 280 | 515 | 745 | 472 |
| 27 | P | 1250 | 60 | 790 | 300 | 240 | 520 | 721 | 472 |
| 28 | Q | 1150 | 60 | 800 | 150 | 260 | 500 | 784 | 478 |
| 29 | R | 1200 | 60 | 785 | 350 | 270 | 520 | 816 | 507 |
| 30 | S | 1150 | 60 | 800 | 300 | 260 | 515 | 815 | 507 |
| 31 | T | 1200 | 60 | 805 | 350 | 290 | 520 | 816 | 505 |
| 32 | U | 1250 | 60 | 795 | 350 | 190 | 530 | 815 | 506 |
| 33 | V | 1200 | 60 | 780 | 350 | 260 | 520 | 816 | 506 |
| 34 | W | 1150 | 60 | 790 | 350 | 270 | 515 | 818 | 507 |
| 35 | X | 1200 | 60 | 800 | 350 | 240 | 520 | 811 | 502 |
| 36 | Y | 1150 | 60 | 800 | 400 | 220 | 520 | 813 | 508 |
| 37 | Z | 1200 | 60 | 805 | 350 | 185 | 510 | 782 | 488 |

| steel sheet No | second cooling step: air cooling time (s) | second cooling step: average cooling rate at center of sheet thickness ((C./s) | second cooling step: cooling stop temperature* ((C.) | third cooling step: coiling temperature ((C.) | third cooling step: keep time between 350 and 600° C. (min) | remarks |
|---|---|---|---|---|---|---|
| 21 | 0.3 | 58 | 495 | 475 | 30 or more | comparison example |
| 22 | 0.3 | 54 | 515 | 495 | 30 or more | present invention example |
| 23 | 0.3 | 55 | 530 | 505 | 30 or more | present invention example |
| 24 | 0.3 | 53 | 555 | 520 | 30 or more | present invention example |
| 25 | 0.3 | 53 | 500 | 480 | 30 or more | comparison example |
| 26 | 0.3 | 55 | 535 | 510 | 30 or more | comparison example |
| 27 | 0.3 | 61 | 495 | 475 | 30 or more | comparison example |
| 28 | 0.3 | 57 | 520 | 500 | 30 or more | comparison example |
| 29 | 0.3 | 59 | 495 | 470 | 30 or more | comparison example |
| 30 | 0.3 | 53 | 515 | 490 | 30 or more | comparison example |
| 31 | 0.3 | 50 | 540 | 515 | 30 or more | comparison example |
| 32 | 0.3 | 60 | 530 | 505 | 30 or more | comparison example |
| 33 | 0.3 | 53 | 505 | 480 | 30 or more | comparison example |
| 34 | 0.3 | 58 | 520 | 500 | 30 or more | comparison example |
| 35 | 0.3 | 55 | 510 | 490 | 30 or more | present invention example |
| 36 | 0.3 | 58 | 450 | 430 | 30 or more | present invention example |
| 37 | 0.3 | 26 | 480 | 460 | 30 or more | present invention example |

*temperature at the center position of sheet thickness

**value calculated using $Ar_3$(° C.) = 910-310C—80Mn—20Cu—15Cr—55Ni—80Mo

***value calculated using Ms(° C.) = 561-474C—33Mn—17Ni—17Cr—21Mo

TABLE 11

| steel sheet No. | steel No. | sheet thickness (mm) | structure: surface layer kind*; fraction (area %) | structure: center of sheet thickness kind*; fraction (area %) | hardness surface layer hardness HV | tensile strength YS (MPa) | tensile strength TS (MPa) | toughness vE-8 (J) | circumferential weldability | HIC resistance: CLR (%) | HIC resistance: presence or no presence of occurrence of blister | remarks |
|---|---|---|---|---|---|---|---|---|---|---|---|---|
| 1 | A | 15.9 | BF: 100 | BF: 100 | 212 | 508 | 579 | 268 | ○ | 0 | no presence | present invention example |
| 2 | A | 19.1 | BF: 100 | BF: 100 | 223 | 501 | 574 | 224 | ○ | 0 | no presence | present invention example |
| 3 | A | 19.1 | BF: 95, P: 5 | F: 90, P: 10 | 234 | 498 | 589 | 63 | ○ | 15 | no presence | comparison example |
| 4 | A | 15.9 | F: 85, P: 15 | F: 80, P: 20 | 256 | 503 | 579 | 22 | ○ | 10 | presence | comparison example |
| 5 | A | 12.7 | M: 75, | BF: 95, P: 5 | 278 | 511 | 586 | 20 | ○ | 15 | presence | comparison example |

TABLE 11-continued

| steel sheet No. | steel No. | sheet thickness (mm) | structure: surface layer kind*; fraction (area %) | structure: center of sheet thickness kind*; fraction (area %) | hardness surface layer hardness HV | tensile strength YS (MPa) | tensile strength TS (MPa) | toughness vE-8 (J) | circumferential weldability | HIC resistance: CLR (%) | HIC resistance: presence or no presence of occurrence of blister | remarks |
|---|---|---|---|---|---|---|---|---|---|---|---|---|
| 6 | A | 15.9 | BF: 100 | BF: 100 | 214 | 490 | 568 | 255 | ○ | 0 | no presence | present invention example |
| 7 | A | 20.6 | BF: 100 | BF: 100 | 209 | 459 | 516 | 226 | ○ | 10 | no presence | comparison example |
| 8 | A | 15.9 | BF: 100 | BF: 100 | 216 | 502 | 576 | 215 | ○ | 0 | no presence | present invention example |
| 9 | A | 20.6 | BF: 100 | BF: 100 | 213 | 507 | 584 | 215 | ○ | 0 | no presence | present invention example |
| 10 | A | 15.9 | M: 70, BF: 30 | BF: 95, M: 5 | 264 | 498 | 581 | 56 | ○ | 15 | presence | comparison example |
| 11 | A | 33.4 | BF: 100 | BF: 100 | 199 | 501 | 590 | 246 | ○ | 0 | no presence | present invention example |
| 12 | A | 12.7 | BF: 100 | BF: 100 | 203 | 497 | 596 | 261 | ○ | 0 | no presence | present invention example |
| 13 | B | 19.1 | BF: 100 | BF: 100 | 204 | 512 | 634 | 237 | ○ | 0 | no presence | present invention example |
| 14 | C | 19.1 | BF: 100 | BF: 100 | 213 | 501 | 608 | 241 | ○ | 0 | no presence | present invention example |
| 15 | D | 15.9 | BF: 100 | BF: 100 | 196 | 497 | 598 | 224 | ○ | 0 | no presence | present invention example |
| 16 | E | 19.1 | BF: 100 | BF: 100 | 206 | 522 | 607 | 264 | ○ | 0 | no presence | present invention example |
| 17 | F | 15.9 | BF: 100 | BF: 100 | 207 | 496 | 561 | 238 | ○ | 0 | no presence | present invention example |
| 18 | G | 12.7 | BF: 100 | BF: 100 | 218 | 514 | 598 | 251 | ○ | 0 | no presence | present invention example |
| 19 | H | 15.9 | BF: 100 | BF: 100 | 194 | 517 | 617 | 224 | ○ | 0 | no presence | present invention example |
| 20 | I | 19.1 | BF: 100 | BF: 100 | 209 | 562 | 629 | 274 | ○ | 0 | no presence | present invention example |

*BE: bainitic ferrite, B: bainite, M: martensite, F: ferrite, P: pearlite

TABLE 12

| steel sheet No. | steel No. | sheet thickness (mm) | structure: surface layer kind*; fraction (area %) | structure: center of sheet thickness kind*; fraction (area %) | hardness surface layer hardness HV | tensile strength YS (MPa) | tensile strength TS (MPa) | toughness vE-8 (J) | circumferential weldability | HIC resistance: CLR (%) | HIC resistance: presence or no presence of occurrence of blister | remarks |
|---|---|---|---|---|---|---|---|---|---|---|---|---|
| 21 | J | 15.9 | BF: 95, M: 5 | BF: 100 | 247 | 517 | 609 | 11 | ○ | 15 | presence | comparison example |
| 22 | K | 15.9 | BF: 100 | BF: 100 | 206 | 494 | 574 | 241 | ○ | 0 | no presence | present invention example |
| 23 | L | 15.9 | BF: 100 | BF: 100 | 197 | 559 | 638 | 237 | ○ | 0 | no presence | present invention example |
| 24 | M | 15.9 | BF: 100 | BF: 100 | 215 | 513 | 584 | 246 | ○ | 0 | no presence | present invention example |
| 25 | N | 15.9 | F: 90, P: 10 | F: 75, P: 25 | 168 | 432 | 514 | 222 | x | 15 | no presence | comparison example |
| 26 | O | 15.9 | BF: 90, M: 10 | BF: 95, M: 5 | 263 | 569 | 633 | 17 | x | 15 | presence | comparison example |
| 27 | P | 15.9 | BF: 95, M: 5 | BF: 100 | 240 | 516 | 631 | 217 | ○ | 5 | presence | comparison example |
| 28 | Q | 15.9 | M: 60, BF: 40 | F: 90, P: 10 | 256 | 574 | 684 | 29 | x | 10 | presence | comparison example |
| 29 | R | 15.9 | F: 95, P: 5 | F: 80, P: 20 | 239 | 539 | 608 | 26 | ○ | 5 | no presence | comparison example |
| 30 | S | 15.9 | BF: 100 | BF: 100 | 217 | 557 | 637 | 37 | x | 15 | no presence | comparison example |
| 31 | T | 15.9 | BF: 90, M: 10 | BF: 100 | 249 | 508 | 607 | 17 | x | 5 | presence | comparison example |
| 32 | U | 15.9 | BF: 100 | BF: 100 | 221 | 569 | 664 | 50 | ○ | 10 | no presence | comparison example |
| 33 | V | 15.9 | BF: 100 | BF: 100 | 251 | 539 | 609 | 27 | x | 10 | presence | comparison example |
| 34 | W | 15.9 | BF: 100 | BF: 100 | 237 | 522 | 597 | 28 | ○ | 20 | no presence | comparison example |
| 35 | X | 15.9 | BF: 100 | BF: 100 | 203 | 521 | 580 | 240 | ○ | 0 | no presence | present invention example |
| 36 | Y | 15.9 | BF: 100 | BF: 100 | 206 | 498 | 566 | 235 | ○ | 0 | no presence | present invention example |
| 37 | Z | 19.1 | BF: 100 | BF: 100 | 204 | 531 | 608 | 262 | ○ | 0 | no presence | present invention example |

*BF: bainitic ferrite, B: bainite, M: martensite, F: ferrite, P: pearlite

What is claimed:

1. A method of manufacturing a thick-walled high-strength hot rolled steel sheet having surface layer hardness of 230HV or less in terms of Vickers hardness, wherein in manufacturing a hot rolled steel sheet by applying hot rolling consisting of rough rolling and finish rolling to a raw steel material having a composition which contains by mass % 0.02 to 0.08% C, 1.0% or less Si, 0.50 to 1.85% Mn, 0.03% or less P, 0.005% or less S, 0.1% or less Al, 0.02 to 0.10% Nb, 0.001 to 0.05% Ti, 0.0005% or less B, and Fe and unavoidable impurities as a balance, such that the composition satisfies the following formula: (Ti+Nb/2)/C<4, where Ti, Nb, and C are contents of the respective elements by mass %, and after the finish rolling is finished, a first cooling step in which the hot rolled steel sheet is cooled by accelerated cooling at an average surface cooling rate of 30° C./s or more until a surface temperature becomes 500° C. or below, a second cooling step in which the hot rolled steel sheet is cooled by air cooling for 10 s or less after the first cooling step is finished, and a third cooling step in which the hot rolled steel sheet is cooled by accelerated cooling to a temperature which falls within a temperature range from 350° C. or above to a temperature below 600° C. at the center of a sheet-thickness at an average cooling rate of 10° C./s or more at the center of the sheet-thickness are applied to the hot rolled steel sheet, and the hot rolled steel sheet is coiled in a coil shape after the third cooling step is finished.

2. The method of manufacturing a thick-walled high-strength hot rolled steel sheet according to claim 1, wherein the accelerated cooling in the third cooling step is cooling performed at a heat flow rate of 1.5 Gcal/$m^2$ hr or more in entire surface nuclear boiling.

3. The method of manufacturing a thick-walled high-strength hot rolled steel sheet according to claim 1, wherein the composition further contains by mass % one or two kinds or more selected from a group consisting of 0.5% or less V, 1.0% or less Mo, 1.0% or less Cr, 4.0% or less Ni, and 2.0% or less Cu in addition to the composition.

4. The method of manufacturing a thick-walled high-strength hot rolled steel sheet according to claim 1, wherein the composition further contains by mass % one or two kinds selected from a group consisting of 0.010% or less Ca, 0.02% or less REM, and 0.003% or less Mg in addition to the composition.

5. The method of manufacturing a thick-walled high-strength hot rolled steel sheet according to claim 1, wherein the composition further satisfies at least one of a condition that Ceq defined by a following formula (2) is 0.32% or less and a condition that Pcm defined by a following formula (3) is 0.13% or less, wherein $$Ceq=C+Mn/6+(Cr+Mo+V)/5+(Cu+Ni)/15 \quad (2)$$

$$Pcm=C+Si/30+(Mn+Cu+Cr)/20+Ni/60+Mo/15+V/10+5B \quad (3)$$

Here, C, Si, Mn, Cr, Mo, V, Cu, Ni, B: contents of respective elements (mass %).

6. A method of manufacturing a thick-walled high-strength hot rolled steel sheet having tensile strength of 520 MPa or more and a surface layer hardness of 230HV or less in terms of Vickers hardness, wherein in manufacturing a hot rolled steel sheet by applying hot rolling consisting of rough rolling and finish rolling to a raw steel material having a composition which contains by mass % 0.02 to 0.08% C, 1.0% or less Si, 0.50 to 1.85% Mn, 0.03% or less P, 0.005% or less S, 0.1% or less Al, 0.02 to 0.10% Nb, 0.001 to 0.05% Ti, 0.0005% or less B, and Fe and unavoidable impurities as a balance, such that the composition satisfies the following formula: (Ti+Nb/2)/C<4, where Ti, Nb, and C are contents of the respective elements by mass %, and after the finish rolling is finished, a first cooling step in which the hot rolled steel sheet is cooled by accelerated cooling at an average cooling rate of 20° C./s or more and less than a martensite formation critical cooling rate on a surface of the hot rolled steel sheet until a surface temperature becomes a temperature not more than an $A_{r3}$ transformation temperature and not less than an Ms temperature, a second cooling step in which the hot rolled steel sheet is rapidly cooled to a temperature within a temperature range from 350° C. or above to a temperature below 600° C. at the center of a sheet-thickness after the first cooling step is finished, and a third cooling step in which, after the second cooling step is finished, the hot rolled steel sheet is coiled in a coil shape at a coiling temperature falling within a temperature range from 350° C. or above to a temperature below 600° C. in terms of a temperature at the center of sheet-thickness and, thereafter, a temperature of the hot rolled steel sheet at least at a position of ¼ sheet-thickness to ¾ sheet-thickness in a coil thickness direction is held or kept within a temperature range from 350° C. or above to a temperature below 600° C. for 30 min or more are sequentially applied to the hot rolled steel sheet.

7. The method of manufacturing a thick-walled high-strength hot rolled steel sheet according to claim 6, wherein the rapid cooling in the second cooling step is cooling at a heat flow rate of 1.0 Gcal/$m^2$ hr or more in entire surface nuclear boiling.

8. The method of manufacturing a thick-walled high-strength hot rolled steel sheet according to claim 6, wherein the composition further contains by mass % one or two kinds or more selected from a group consisting of 0.5% or less V, 1.0% or less Mo, 1.0% or less Cr, 4.0% or less Ni, and 2.0% or less Cu in addition to the composition.

9. The method of manufacturing a thick-walled high-strength hot rolled steel sheet according to claim 6, wherein the composition further contains by mass % one or two kinds selected from a group consisting of 0.010% or less Ca, 0.02% or less REM, 0.003% or less Mg in addition to the composition.

10. The method of manufacturing a thick-walled high-strength hot rolled steel sheet according to claim 6, wherein the composition further satisfies at least one of a condition that Ceq defined by a following formula (2) is 0.32% or less and a condition that Pcm defined by a following formula (3) is 0.13% or less, wherein $$Ceq=C+Mn/6+(Cr+Mo+V)/5+(Cu+Ni)/15 \quad (2)$$

$$Pcm=C+Si/30+(Mn+Cu+Cr)/20+Ni/60+Mo/15+V/10+5B \quad (3)$$

C, Si, Mn, Cr, Mo, V, Cu, Ni, B: contents of respective elements (mass %).

* * * * *